US005984006A

United States Patent [19]

Read et al.

[11] Patent Number: 5,984,006

[45] Date of Patent: Nov. 16, 1999

[54] EMERGENCY RELEASE TOOL

[75] Inventors: Dennis M. Read, Houston; Dwayne D. Leismer, Pearland, both of Tex.

[73] Assignee: Camco International Inc., Houston, Tex.

[21] Appl. No.: 08/943,887

[22] Filed: Oct. 3, 1997

Related U.S. Application Data

[60] Provisional application No. 60/027,620, Oct. 4, 1996.

[51] Int. Cl.[6] ..... E21B 23/00; E21B 23/04

[52] U.S. Cl. ..... 166/63; 166/65.1; 166/66.6; 166/242.2; 166/242.6; 166/242.7; 285/376

[58] Field of Search ..... 166/63, 65.1, 66.6, 166/242.2, 242.6, 242.7, 377; 285/39, 360, 376, 401

[56] References Cited

U.S. PATENT DOCUMENTS

| | | | |
|---|---|---|---|
| 1,916,449 | 7/1933 | Tompkins . | |
| 4,476,945 | 10/1984 | Hearn | 175/203 |
| 4,526,233 | 7/1985 | Stout | 166/377 |
| 4,611,662 | 9/1986 | Harrington | 166/242.6 |
| 4,877,089 | 10/1989 | Burns | 166/377 |
| 4,878,695 | 11/1989 | Whitham . | |
| 4,913,229 | 4/1990 | Hearn | 166/156 |
| 4,949,791 | 8/1990 | Hopmann et al. | 166/378 |
| 4,984,632 | 1/1991 | Sampa et al. | 166/242.6 |
| 5,109,921 | 5/1992 | Aracena | 166/65.1 |
| 5,156,206 | 10/1992 | Cox | 166/242.2 |
| 5,201,814 | 4/1993 | Kitchell et al. | 166/65.1 |
| 5,265,675 | 11/1993 | Hearn | 166/297 |
| 5,323,853 | 6/1994 | Leismer | 166/55 |
| 5,339,913 | 8/1994 | Rives | 166/117.7 X |
| 5,370,180 | 12/1994 | Barbee | 166/178 |
| 5,419,399 | 5/1995 | Smith | 166/377 |
| 5,607,250 | 3/1997 | Tatterson et al. | 166/377 X |
| 5,762,142 | 6/1998 | Connell et al. | 166/325 |

FOREIGN PATENT DOCUMENTS

| | | |
|---|---|---|
| 0 260 878 | 10/1987 | European Pat. Off. . |
| 0 681 085 A2 | 3/1995 | European Pat. Off. . |
| 1504861 | 11/1966 | France . |
| 2165607 | 4/1986 | United Kingdom . |
| WO95/08401 | 3/1995 | WIPO . |

*Primary Examiner*—George Suchfield
*Attorney, Agent, or Firm*—Tobor, Goldstein & Healey, LLP

[57] ABSTRACT

An improved emergency release tool is provided to releasably connect a coiled tubing to one or more downhole tools. The emergency release tool broadly includes a releasable slip for holding a coiled tubing, the releasable slip being secured to a first end of a slip case, the slip case being disposed within a slip housing and a lower housing, the slip housing being movable from a locked position to a released position; a piston slidably disposed about the slip case and being moveable from a locked position to a released position; a first end of the lower housing being releasably connected to a second end of the slip housing when the slip housing is in its locked position; and, a remotely activated means for moving the piston and the slip housing from their locked positions to their released positions to disengage the releasable slip from the coiled tubing and enable the coiled tubing to be removed from the tool. A quick disconnect coupler is also provided, and broadly includes a pin connector having a series of lugs; a box connector for receiving the pin connector and having a series of recesses to engage and hold the lugs inside the box connector; and, a load ring between the box connector and the pin connector for transmitting compressive loads through the connection.

67 Claims, 12 Drawing Sheets

EMERGENCY RELEASE TOOL

RELATED APPLICATIONS

This application claims the benefit of U.S. Provisional Application No. 60/027,620, filed Oct. 4, 1996.

BACKGROUND OF THE INVENTION

1. Field of the Invention

The present invention relates to subsurface well drilling equipment and, more particularly, to apparatus for connecting and disconnecting components of a bottom hole assembly to a tubing, but preferably coiled tubing, and for connecting and disconnecting components to other components of the bottom hole assembly.

2. Description of the Related Art

A Bottom Hole Assembly (commonly referred to in the industry as a BHA) for drilling wells with a coiled tubing comprises various constituent parts which may include: a drill bit, a bent sub for changing the vertical angle of penetration, a motor for rotating the bit, a circulating sub for flowing drilling mud to prevent sticking of the BHA in the well, an orienting tool for changing the direction of penetration, a thruster for providing weight on the bit, and a sub which provides a means for selectively attaching and releasing the BHA from the coiled tubing. The present invention is directed to a device which is a significant improvement over the prior art for selectively attaching and releasing the BHA from the coiled tubing.

While drilling wells, it is possible for the BHA to become lodged downhole due to differential pressure that may exist in the well and/or a cave-in of the hole, or excessive friction due to well trajectory. Coiled tubing has a relatively smaller wall thickness than conventional drill pipe, and therefore has a reduced tensile strength, and therefore a reduced capacity to pull a lodged BHA from a well. This is especially true if a portion of the well has been drilled horizontally. If the tensile strength of the coiled tubing is exceeded while attempting to pull the BHA from the well, tensile failure can occur, resulting in an unpredictable parting of the tubing. The presence of an unpredictable length and configuration of coiled tubing left in the well with the lodged BHA makes retrieval difficult, if not impossible, and can result in the loss of the expensive BHA and the possible abandonment of the well. Prior art references are as follows, all of which are U.S. Pat. Nos. 5,323,853; 4,476,945; 4,913,229; 5,265,675.

There is a need for a device to allow coiled tubing to be easily pulled from or attached to the connector on a first end, and on a second end, have a connector that may quickly and easily be removed from and attached to the BHA.

SUMMARY OF THE INVENTION

The present invention has been contemplated to overcome the foregoing deficiencies and meet the above described needs.

The invention is an Emergency Release Tool that connects a coiled tubing to a Bottom Hole Assembly (BHA) and is electrically activated upon a signal from the surface. The electrical signal may ignite a propellant, or release gas, or it may activate a downhole hydraulic or gaseous fluid source, or actuate a solenoid, motor, or heating coil to enable the release of the coiled tubing from the Emergency Release Tool. Other well known methods of applying fluidic pressure to operate a downhole tool may also be employed and still be within the scope and spirit of the present invention. In the preferred embodiment, activation of the fluidic pressure release means causes the mechanism described in the attached drawings to release the coiled tubing, such that it pulls free of the Emergency Release Tool in a completely non-destructive manner, as well as enabling removal of any additional restraints, such as an electric line. The release of only the tubing leaves no enlarged or "upset" areas attached to the tubing which can interfere with the removal of the tubing from the well. The Emergency Release Tool leaves at least one profile (commonly known as a fishing profile) upon which a robust pulling tool can be engaged, greatly enhancing the possibility that the lodged BHA can be removed from the well. On the lower end of the Emergency Release Tool, a quick disconnect has been developed to enable quick and easy attachment to the BHA. This quick disconnect operates by insertion of a pin (or male) connection inside of a box (or female) connection, the locking of which is accomplished by a fractional portion of one full rotation. Fluidic seal of the two halves is accomplished by an o-ring, packing, metal seal, or other well known means.

When attaching the Emergency Release Tool to tubing, only deburring of the tubing is necessary for installation. This allows simple and cost effective field assembly to be completed quickly at any time. The device may be easily removed from the coiled tubing without the need for redress, or with minor redress, before being reattached. When remotely activated, the fluidic pressure release means shifts a sleeve to relieve pressure on a slip which anchors the device to the coil. The expanding gas pressure continues to transmit force to unseat the slips and their restraints. Movement of the sleeve mechanically releases an electric line or "E-line" (or other conduit inside the coiled tubing) and separates the slips from a loading nut to prevent the slips from re-engaging. The tubing and "E-line" slide from the Emergency Release Tool leaving only the OD of the tubing, continuous to the surface, to be removed from the hole. The fishing profile would simultaneously be revealed to allow later retrieval of the lodged tool, if desired. In the event of lodged or damaged tubing, the "E-line" may be pulled from the device and the tubing may be retrieved by conventional well retrieval methods.

The Emergency Release is connected to the rest of the tool string by way of a locking "Quick Connect." This connection allows minimal rotation of parts being assembled, eases and quickens repair or replacement of components, and provides a universal profile to simplify custom configurations. A series of lugs on the pin portion are positioned in recesses in the box portion and then are held in place by a rigid spacer which transmits compressive loads through the connection. The lugs transmit all tensile and torque forces through the connection and the integral sealing means in the body of the connector maintain a fluidic pressure seal under the harsh conditions that exist when drilling with coiled tubing. This connection can be used with most of the components of the BHA as well as the Emergency Release Tool. This enables a beneficial modularity whereby specific devices may be added, removed, or changed in relative position in the BHA.

One skilled in the art of coiled tubing drilling will immediately appreciate the benefits of the Emergency Release Tool of the present invention, since: it leaves a smooth OD for highest probability of coil extraction; attachment to the tubing requires no machining or preparation of tubing other than deburring; the tool is activated remotely when desired; it does not rely on any external forces being applied to the device; it will operate without moving the tubing or the attached tools; it also reveals a robust fishing neck for alternate retrieval methods of the conveyed tool; it can be used with "E-line," control line, umbilical, etc., installed in the tubing; a redundant "E-line" disconnect allows conventional extraction of "E-line" if tubing is still lodged or damaged allowing conventional coiled tubing recovery; and the tool has a proven "Quick Connect" profile for convenience and modularity.

In one aspect, the invention includes an emergency release tool comprising: a releasable slip for holding a coiled tubing, the releasable slip being secured to a first end of a slip case, the slip case being disposed within a slip housing and a lower housing, the slip housing being movable from a locked position to a released position; a piston slidably disposed about the slip case and being moveable from a locked position to a released position; a first end of the lower housing being releasably connected to a second end of the slip housing when the slip housing is in its locked position; and, a remotely activated means for moving the piston and the slip housing from their locked positions to their released positions to disengage the releasable slip from the coiled tubing and enable the coiled tubing to be removed from the tool. Another feature of this aspect of the invention is that the tool may further include a loading nut movably secured to a first end of the slip housing and mating with the releasable slip for holding the coiled tubing. Another feature of this aspect of the invention is that the loading nut may be threadably secured to the first end of the slip housing. Another feature of this aspect of the invention is that the loading nut may include a flared portion for mating with a flared portion on the releasable slip. Another feature of this aspect of the invention is that the flared portions on the loading nut and on the slip may be flared at angles of approximately three degrees. Another feature of this aspect of the invention is that the loading nut may include a fishing profile for engaging a well tool to be used in retrieving the emergency release tool and a bottom hole assembly attached thereto upon the coiled tubing being released from the emergency release tool. Another feature of this aspect of the invention is that the second end of the slip housing may further include at least one dog and is telescopically received within the first end of the lower housing, the piston holding the at least one dog in an annular recess in the first end of the lower housing when the piston is in its locked position to connect the slip housing to the lower housing, and the piston releasing the at least one dog to disconnect the slip housing and the lower housing and moving the slip housing to its released position when the piston is moved from its locked position to its released position. Another feature of this aspect of the invention is that the annular recess in the lower housing may function as a redundant fishing profile for engaging a well tool to be used in retrieving the emergency release tool and a bottom hole assembly attached thereto upon the coiled tubing being released from the emergency release tool and upon detachment from the tool of the releasable slip, the slip case, the slip housing, and the piston. Another feature of this aspect of the invention is that the lower housing may further include an annular load bearing shoulder that may function as a redundant fishing profile for engaging a well tool to be used in retrieving the emergency release tool and a bottom hole assembly attached thereto upon the coiled tubing being released from the emergency release tool and upon detachment from the tool of the releasable slip, the slip case, the slip housing, and the piston. Another feature of this aspect of the invention is that the slip case may include an outer surface having a shoulder and at least one recess for housing at least one locking dog, the at least one locking dog being in a compressed position when the slip housing is in its locked position, and the at least one locking dog being moveable to engage an annular recess within the slip housing when the slip housing is in its released position. Another feature of this aspect of the invention is that the piston may be releasably secured to the lower housing when the piston is in its locked position. Another feature of this aspect of the invention is that the tool may further include a collet being releasably connected to the piston and to the lower housing, the collet being released from the piston when the piston is shifted from its locked position to its released position. Another feature of this aspect of the invention is that the collet may include a plurality of fingers having threaded portions at distal ends thereof for mating with a threaded portion on the lower housing to releasably secure the collet to the lower housing. Another feature of this aspect of the invention is that the collet may be releasably secured to the piston by a shear pin. Another feature of this aspect of the invention is that the slip case may further include a locking shoulder for loading the distal ends of the collet fingers when a well tool is being used to engage a fishing profile on the tool to retrieve the tool and an attached bottom hole assembly. Another feature of this aspect of the invention is that the remotely activated means may include a propellant that, when ignited, forces the piston and the slip housing from their locked positions to their released positions. Another feature of this aspect of the invention is that the propellant may be disposed about the slip case and beneath the piston, and may be remotely ignited by an electrical signal. Another feature of this aspect of the invention is that the remotely activated means may include a gas that, when released, forces the piston and the slip housing from their locked positions to their released positions. Another feature of this aspect of the invention is that the remotely activated means may include a heating coil, when energized, forces the piston and the slip housing from their locked positions to their released positions. Another feature of this aspect of the invention is that the remotely activated means may include an electrically actuated valve for controlling the interaction of a compressed gas source with the piston to force the piston and the slip housing from their locked positions to their released positions. Another feature of this aspect of the invention is that the remotely activated means may include an electrically actuated valve for controlling the interaction of a hydraulic fluid source with the piston to force the piston and the slip housing from their locked positions to their released positions. Another feature of this aspect of the invention is that the remotely activated means may be connected to and activated by a conductor cable running through the coiled tubing from the earth's surface to the tool. Another feature of this aspect of the invention is that the conductor cable may be remotely detached from the emergency release tool and removed from the coiled tubing so that conventional well tools may be used to remove the emergency release tool and a bottom hole assembly attached thereto from the well. Another feature of this aspect of the invention is that the tool may further include means for sealing individual conductors within the conductor cable from drilling fluid being circulated through the tool.

Another feature of this aspect of the invention is that the conductor sealing means may include: an anchor, an armor nut, a conductor cable sealing connector, and a flow tube; the anchor being received within the coiled tubing and removably connected to the armor nut; the anchor and the armor nut having cooperating inclined surfaces for holding an armor portion of the conductor cable; the conductor cable sealing connector having a plurality of longitudinal bores extending therethrough and including a carrier plug, a composite seal, and a follower plug, the composite seal being disposed between the carrier plug and the follower plug, and each of the individual conductors passing through one of the plurality of longitudinal bores; and, a first end of the flow tube being connected to the armor nut to compress the sealing connector between a shoulder on the flow tube and a shoulder on the armor nut and to compress the composite seal and seal the individual conductors from the drilling fluid, and a second end of the flow tube being received within a longitudinal bore of the inner mandrel. Another feature of this aspect of the invention is that the conductor cable may be remotely detached from the tool by shearing the armor from between the anchor and the armor nut and removed from the coiled tubing so that conventional well tools may be used to remove the emergency release tool and a bottom hole assembly attached thereto from the well. Another feature of this aspect of the invention is that the piston includes a shoulder disposed beneath an aperture in the slip housing, whereby well bore pressure is applied through the aperture to the piston shoulder to maintain a downward force on the piston to counteract any upward forces on the piston that may develop during the drilling process, other than forces generated as a result of the activation of the remotely activated means. Another feature of this aspect of the invention is that the tool releases the coiled tubing in a nondestructive manner so as to leave no enlarged diameters on the tubing that could interfere with removal of the coiled tubing from a well. Another feature of this aspect of the invention is that, upon activation of the remotely activated means to disengage the coiled tubing from the tool, no part of a conductor sealing means within the tool is larger than an outer diameter of the coiled tubing, so that removal of the conductor sealing means from the tool will not interfere with removal of the coiled tubing from a well. Another feature of this aspect of the invention is that the coiled tubing is released from the tool solely by remote activation of the remotely activated means without mechanical manipulation of the emergency release tool by a well tool. Another feature of this aspect of the invention is that the coiled tubing is released from the tool solely by remote activation of the remotely activated means without movement of the coiled tubing. Another feature of this aspect of the invention is that the coiled tubing is released from the tool solely by remote activation of the remotely activated means without movement of a bottom hole assembly connected to the emergency release tool. Another feature of this aspect of the invention is that the coiled tubing need only be deburred to be installed adjacent the releasable slip. Another feature of this aspect of the invention is that the tool may further include a quick disconnect coupler attached to a second end of the lower housing, the quick disconnect coupler including a pin connector having a series of lugs, a box connector for receiving the pin connector and having a series of recesses to engage and hold the lugs, a rigid spacer between the box and pin connectors for transmitting operating loads through the connection, and an integral sealing means for maintaining a fluidic pressure seal between the pin and box connectors.

In another aspect, the emergency release tool may comprise: a loading nut having a longitudinal bore extending therethrough, a first end, and a second end having an outer surface, the longitudinal bore having a flared portion at the second end of the loading nut, and the outer surface of the second end having a threaded portion; a slip housing having a longitudinal bore extending therethrough, a first end, and second end, the longitudinal bore having a threaded portion at the first end of the slip housing for mating with the threaded portion on the loading nut and an annular recess forming a shoulder, and the second end of the slip housing having at least one dog; a lower housing having a longitudinal bore extending therethrough, a first end, and second end, the second end of the slip housing being telescopically received within the longitudinal bore of the lower housing at the first end thereof, and an annular recess at the first end of the lower housing for receiving the at least one dog in the second end of the slip housing; a slip case having a longitudinal bore extending therethrough, a first end, a second end, and an outer surface, the outer surface having a shoulder and at least one recess, the at least one recess housing at least one locking dog; at least one slip connected to the first end of the slip case and having a flared end for mating with the flared end of the loading nut and an inner surface, the inner surface having gripping teeth for gripping a coiled tubing; a piston disposed for longitudinal movement around the slip case and being releasably secured to the lower housing when the tool is in a locked position, the at least one dog in the second end of the slip housing being held within the annular recess in the lower housing by the piston when the tool is in the locked position, the piston being movable to release the at least one dog from the annular recess when the tool is being shifted from its locked position to a released position; and a remotely activated means for moving the tool from its locked position to its released position to disengage the at least one slip from the coiled tubing.

Another feature of this aspect of the present invention is that the tool may further include a collet being releasably connected to the piston and to the lower housing, the collet being released from the piston when the tool is shifted from its locked position to its released position. Another feature of this aspect of the present invention is that the collet may be releasably secured to the piston by at least one shear pin. Another feature of this aspect of the present invention is that the collet may further include a body portion having a plurality of fingers depending therefrom, the fingers having distal ends, the distal ends having a threaded portion engaged with a threaded portion in the longitudinal bore of the lower housing. Another feature of this aspect of the present invention is that the collet may be disposed around a second extension of the piston and within the longitudinal bore of the lower housing, and the collet body is releasably secured to the second extension of the piston. Another feature of this aspect of the present invention is that the remotely activated means may include a gas that, when released, moves the tool from its locked position to its released position. Another feature of this aspect of the present invention is that the remotely activated means may include a heating coil, when energized, moves the tool from its locked position to its released position. Another feature of this aspect of the present invention is that the remotely activated means may include an electrically actuated valve for controlling the interaction of a compressed gas source with the piston to move the tool from its locked position to its released position. Another feature of this aspect of the present invention is that the remotely activated means may include an electrically actuated valve for controlling the interaction of a hydraulic fluid source with the piston to move the tool from its locked position to its released position. Another feature of this aspect of the present invention is that the remotely activated means may include a propellant that, when ignited, moves the tool from its locked position to its released position. Another feature of this aspect of the present invention is that the propellant may be disposed about the slip case and beneath the piston, and is remotely ignited by an electrical signal.

Another feature of this aspect of the present invention is that the tool may further include: a charge mandrel having a main body portion and a first extension, the charge mandrel being connected to the second end of the slip case and disposed within the longitudinal bore of the lower housing, the first extension having a distal end and a propellant retaining shoulder, the main body portion having a loading shoulder for bearing against an annular load bearing shoulder in the longitudinal bore of the lower housing; and, a propellant retainer ring having an outer surface, a first edge, and a second edge, the retainer ring being movably connected to the distal end of the first extension of the charge mandrel, the propellant being disposed between the longitudinal bore of the lower housing and an outer surface of the first extension of the charge mandrel, and being held in place between the second edge of the ring and the retaining shoulder on the charge mandrel when the tool is in its locked position. Another feature of this aspect of the present invention is that the outer surface of the propellant retainer ring includes at least one recess to facilitate the passage of gases generated upon ignition of the propellant. Another feature of this aspect of the present invention is that the tool may further include: a collet being releasably connected to the piston and to the lower housing, the collet being released from the piston when the tool is shifted from its locked position to its released position, the collet having a body portion having a plurality of fingers depending therefrom, the fingers having distal ends, the distal ends having a threaded portion engaged with a threaded portion in the longitudinal bore of the lower housing; and, a locking shoulder on the outer surface of the propellant retainer ring adjacent a first edge thereof, the locking shoulder loading the distal ends of the collet fingers when a well tool is being used to engage a fishing profile on the tool to retrieve the tool and an attached bottom hole assembly.

Another feature of this aspect of the present invention is that the longitudinal bore of the loading nut may further include a fishing profile for engaging a well tool to be used in retrieving the emergency release tool and a bottom hole assembly attached thereto upon the coiled tubing being released from the emergency release tool, the forces imparted to the fishing profile by the well tool being transferred to the bottom hole assembly through the shoulder on the slip housing that is bearing against the shoulder on the slip case, through the locking shoulder on the propellant retainer ring that is bearing against the distal ends of the collet fingers, and through the threaded portions on the collet fingers that are threadably engaged with the threaded portion on the lower housing, the threaded portions on the collet fingers and the lower housing being designed to fail at a preselected load, whereby, upon the preselected load being exceeded, the collet being disengaged from the lower housing, and the tool, except for the lower housing, being disengaged from the bottom hole assembly. Another feature of this aspect of the present invention is that the main body portion of the charge mandrel may include an electrical conductor conduit for receiving an individual conductor of a conductor cable. Another feature of this aspect of the present invention is that the main body portion may further include a connector disposed in the electrical conductor conduit for connecting an individual conductor of a conductor cable to a conductor connected to the propellant. Another feature of this aspect of the present invention is that the tool may further include an extension connected to a lower end of the charge mandrel for sealably receiving an upper portion of an uppermost tool in a bottom hole assembly. Another feature of this aspect of the present invention is that the piston may include a first extension, a second extension, and a first shoulder adjacent the first extension, the first extension being disposed for longitudinal movement within the longitudinal bore of the slip housing and having an area of increased diameter and an area of reduced diameter, the second extension being disposed for longitudinal movement within the longitudinal bore of the lower housing, the at least one dog in the second end of the slip housing being held within the annular recess in the lower housing by the area of increased diameter on the first extension of the piston when the tool is in its locked position, and the piston being movable to release the at least one dog from the annular recess when the tool is being shifted from its locked position to its released position.

Another feature of this aspect of the present invention is that the flared portions on the loading nut and on the slip may be flared at angles of approximately three degrees. Another feature of this aspect of the present invention is that the second end of the slip housing may include at least one notch for engaging at least one prong on the first end of the lower housing. Another feature of this aspect of the present invention is that the at least one slip may include a T-shaped end for mating with a corresponding T-shaped slot in the first end of the slip case. Another feature of this aspect of the present invention is that the at least one locking dog housed in the slip case may be springloaded. Another feature of this aspect of the present invention is that the piston may include a shoulder disposed beneath an aperture in the slip housing, whereby well bore pressure is applied through the aperture to the piston shoulder to maintain a downward force on the piston to counteract any upward forces on the piston that may develop during the drilling process, other than forces generated as a result of the activation of the remotely activated means. Another feature of this aspect of the present invention is that, when the tool is shifted from a locked position to a released position, the shoulder on the slip case engages the shoulder on the slip housing and the locking dogs move outwardly to engage the annular recess in the slip housing. Another feature of this aspect of the present invention is that the remotely activated means may be connected to and activated by a conductor cable running through the coiled tubing from the earth's surface to the tool. Another feature of this aspect of the present invention is that the conductor cable may be remotely detached from the emergency release tool and removed from the coiled tubing so that conventional well tools may be used to remove the emergency release tool and a bottom hole assembly attached thereto from the well.

Another feature of this aspect of the present invention is that the tool may further include means for sealing individual conductors within the conductor cable from drilling fluid being circulated through the tool. Another feature of this aspect of the present invention is that the conductor sealing means may include: an anchor, an armor nut, a conductor cable sealing connector, and a flow tube; the anchor being received within the coiled tubing and removably connected to the armor nut; the anchor and the armor nut having cooperating inclined surfaces for holding an armor portion of the conductor cable; the conductor cable sealing connector having a plurality of longitudinal bores extending therethrough and including a carrier plug, a composite seal, and a follower plug, the composite seal being disposed between the carrier plug and the follower plug, and each of the individual conductors passing through one of the plurality of longitudinal bores; and, a first end of the flow tube being connected to the armor nut to compress the sealing connector between a shoulder on the flow tube and a shoulder on the armor nut and to compress the composite seal and seal the individual conductors from the drilling fluid, and a second end of the flow tube being received within a longitudinal bore of the inner mandrel. Another feature of this aspect of the present invention is that the conductor cable may be remotely detached from the tool by shearing the armor from between the anchor and the armor nut and removed from the coiled tubing so that conventional well tools may be used to remove the emergency release tool and a bottom hole assembly attached thereto from the well. Another feature of this aspect of the present invention is that the tool releases the coiled tubing in a nondestructive manner so as to leave no enlarged diameters on the tubing that could interfere with removal of the coiled tubing from a well. Another feature of this aspect of the present invention is that, upon activation of the remotely activated means to disengage the coiled tubing from the tool, no part of a conductor sealing means within the tool is larger than an outer diameter of the coiled tubing, so that removal of the conductor sealing means from the tool will not interfere with removal of the coiled tubing from a well. Another feature of this aspect of the present invention is that the coiled tubing may be released from the tool solely by remote activation of the remotely activated means without mechanical manipulation of the emergency release tool by a well tool. Another feature of this aspect of the present invention is that the coiled tubing may be released from the tool solely by remote activation of the remotely activated means without movement of the coiled tubing. Another feature of this aspect of the present invention is that the coiled tubing may be released from the tool solely by remote activation of the remotely activated means without movement of a bottom hole assembly connected to the emergency release tool. Another feature of this aspect of the present invention is that the coiled tubing need only be deburred to be installed adjacent the releasable slip. Another feature of this aspect of the present invention is that the annular recess in the lower housing may function as a redundant fishing profile for engaging a well tool to be used in retrieving the emergency release tool and a bottom hole assembly attached thereto upon the coiled tubing being released from the emergency release tool and upon detachment of the lower housing from the remainder of the emergency release tool. Another feature of this aspect of the present invention is that the lower housing may further include an annular load bearing shoulder that may function as a redundant fishing profile for engaging a well tool to be used in retrieving the emergency release tool and a bottom hole assembly attached thereto upon the coiled tubing being released from the emergency release tool and upon detachment of the lower housing from the remainder of the emergency release tool. Another feature of this aspect of the present invention is that a quick disconnect coupler may be attached to a second end of the lower housing, the quick disconnect coupler including a pin connector having a series of lugs, a box connector for receiving the pin connector and having a series of recesses to engage and hold the lugs, a rigid spacer between the box and pin connectors for transmitting operating loads through the connection, and an integral sealing means for maintaining a fluidic pressure seal between the pin and box connectors.

Another aspect of the present invention may include a quick disconnect coupler. In one aspect, the quick disconnect coupler may include: a pin connector having a series of lugs; a box connector for receiving the pin connector and having a series of recesses to engage and hold the lugs inside the box connector; and, a load ring between the box connector and the pin connector for transmitting compressive loads through the connection. Another feature of this aspect of the present invention is that the quick disconnect coupler may further include an integral sealing means for maintaining a fluidic pressure seal between the pin connector and the box connector. Another feature of this aspect of the present invention is that the box connector and the pin connector may be alternately locked and unlocked by relative rotation of the box and pin connectors, where said rotation is a fraction of a full 360 degree turn.

In another aspect, the quick disconnect coupler may include: a box connector having a longitudinal bore extending therethrough, the longitudinal bore having a plurality of ribs at a first end of the box connector and a plurality of grooves defined between the ribs, each rib having a recess disposed therein; a pin connector having a shoulder adjacent a main body portion and a pin member, the pin member having a plurality of lugs for mating with the recesses in the ribs on the box connector; and, a load ring removably positionable between the shoulder on the pin connector and the first end of the box connector. Another feature of this aspect of the present invention is that the plurality of ribs may be evenly spaced about the circumference of the longitudinal bore of the box connector. Another feature of this aspect of the present invention is that the recess in each rib may be disposed between a first leg and second leg on the rib. Another feature of this aspect of the present invention is that a distal end of each second leg may be located closer to the first end of the box connector than is a distal end of each first leg. Another feature of this aspect of the present invention is that the pin member may further include at least one seal groove for receiving a sealing ring to establish a fluidic pressure seal between the pin connector and box connector. Another feature of this aspect of the present invention is that the coupler may further include a load ring retainer for fastening the load ring between the pin connector and the box connector.

In another aspect, the present invention encompasses a method of using a quick disconnect coupler for connecting a first and a second device, the quick disconnect coupler including a box connector having a longitudinal bore extending therethrough, the longitudinal bore having a plurality of ribs at a first end of the box connector and a plurality of grooves defined between the ribs, each rib having a recess disposed therein, a pin connector having a shoulder adjacent a main body portion and a pin member, the pin member having a plurality of lugs for mating with the recesses in the ribs on the box connector, and a load ring removably positionable between the shoulder on the pin connector and the first end of the box connector, the method comprising the steps of: connecting a second end the box connector to the first device; connecting an end of the pin connector opposite the shoulder to the second device; sliding the lugs on the pin connector into the grooves on the box connector until the shoulder on the pin connector abuts against the first end of the box connector; rotating the pin connector a fraction of a full 360 degree turn until the lugs are positioned adjacent their corresponding recesses; sliding the lugs into their corresponding recesses; and, fastening the load ring around the pin member, and between the shoulder on the pin connector and the first end of the box connector.

Figure 1A:
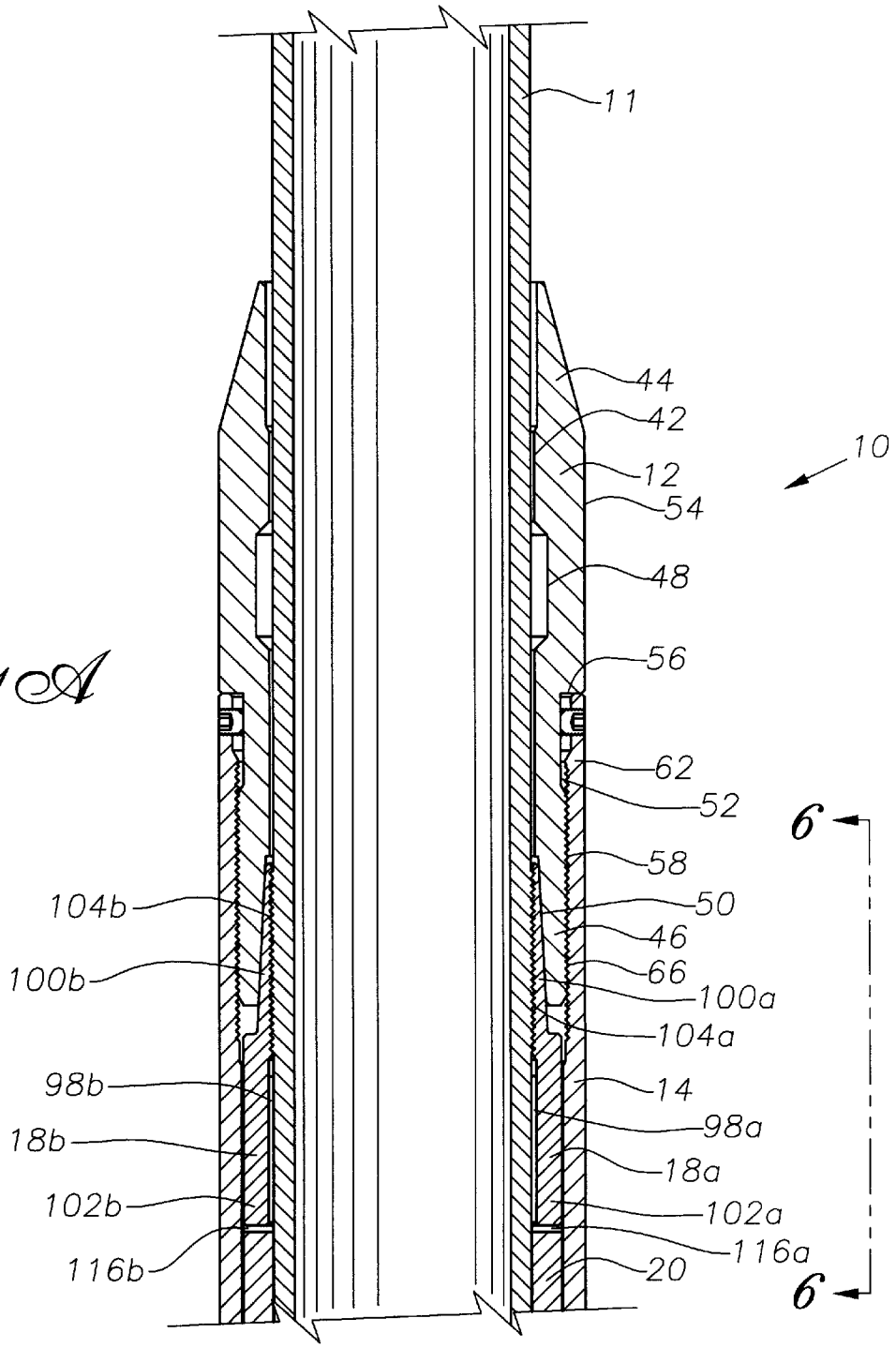
FIGS. 1A–1E illustrate a longitudinal cross-sectional view of a full assembly of an emergency release tool of the present invention.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

In the description which follows, like parts are marked throughout the specification and drawings with the same reference numerals, respectively. The figures are not necessarily drawn to scale, and in some instances, have been exaggerated or simplified to clarify certain features of the invention. One skilled in the art will appreciate many differing applications of the described apparatus.

For the purposes of this discussion, the terms "upper" and "lower", "up hole" and "downhole", and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

FIGS. 1A–1E, taken together, illustrate a longitudinal view of an emergency release tool of the present invention in a locked position and connected to a coiled tubing 11. In a specific embodiment, the emergency release tool 10 includes a loading nut 12, a slip housing 14, a lower housing 16, a first slip 18*a*, a second slip 18*b*, a slip case 20, a piston 22, a collet 24, a propellant retainer ring 26, a propellant 28, a charge mandrel 30, an extension 32, an anchor 34, an armor nut 36, a conductor cable sealing connector 38, and a flow tube 40. In a specific embodiment, the slips 18*a* and 18*b*, the slip case 20, the charge mandrel 30, the propellant retainer ring 26, and the extension 32 may be provided as an integral component, and may be referred to as an inner mandrel. In another specific embodiment, the tool 10 may be provided without the extension 32. In another specific embodiment, the tool 10 may be provided without the anchor 34, the armor nut 36, the conductor cable sealing connector 38, and the flow tube 40, which components are sometimes referred to below as a sealing assembly.

The loading nut 12 includes a longitudinal bore 42 extending therethrough, a first end 44, and a second end 46. The longitudinal bore 42 includes a fishing profile 48, the purpose of which will be explained below. The longitudinal bore 42 at the second end 46 of the loading nut 12 includes a flared portion 50. In a specific embodiment, the flared portion 50 is outwardly flared at approximately a 3-degree angle. An outer surface 52 of the second end 46 of the loading nut 12 is stepped radially inwardly from an outer surface 54 of the first end 44 of the loading nut 12 to form a shoulder 56. The outer surface 52 of the second end 46 of the loading nut 12 includes a threaded portion 58.

Figure 7:
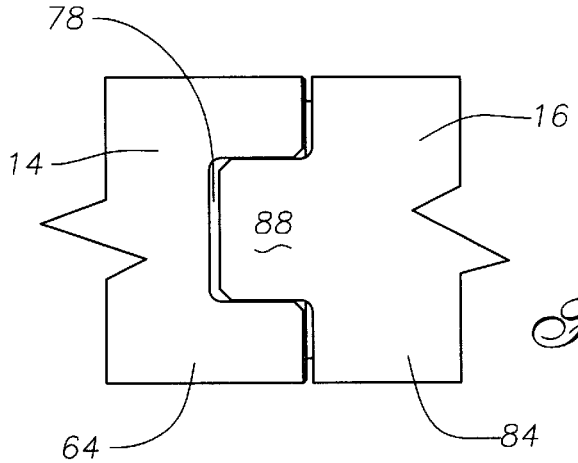
FIG. 7 is a partial elevation view of the emergency release tool illustrating interlocking components, taken along line 7—7 of FIG. 1C.

The slip housing 14 includes a longitudinal bore 60 extending therethrough, a first end 62, and second end 64. The longitudinal bore 60 includes a threaded portion 66 at the first end 62 of the slip housing 14 for mating with the threaded portion 58 on the loading nut 12. The longitudinal bore 60 also includes an annular recess 68 (FIG. 1B) adjacent a shoulder 69, the functions of which will be explained below. An outer surface 70 (FIG. 1C) of the second end 64 of the slip housing 14 is stepped radially inwardly from an outer surface 72 of the first end 62 of the slip housing 14 to form a shoulder 74. The second end 64 of the slip housing 14 includes at least one dog 76, the function and operation of which will be explained below. In a specific embodiment, the slip housing 14 may include four dogs 76. As best shown in FIG. 7, the second end 64 of the slip housing 14 is also provided with a first notch 78 adjacent the shoulder 74. Referring back to FIG. 1C, the slip housing 14 may be provided with a second notch 80 on the opposite side of the slip housing 14 from the first notch 78. The purpose of the notches 78 and 80 will be explained below. The slip housing 14 may also include an aperture 81 above the shoulder 74, the function of which will be explained below.

The lower housing 16 includes a longitudinal bore 82 extending therethrough, a first end 84, and second end 86. As best shown in FIG. 7, the first end 84 of the lower housing 16 is provided with first and second prongs 88 and 90 for mating with the first and second notches 78 and 80 on the second end 64 of the slip housing 14. The second end 64 of the slip housing 14 is telescopically received, at the first end 84 of the lower housing 16, within the longitudinal bore 82 of the lower housing 16. The longitudinal bore 82 includes an annular recess 92 at the first end 84 of the lower housing 16 for receiving the at least one dog 76 in the second end 64 of the slip housing 14, as will be more fully explained below. The longitudinal bore 82 of the lower housing 16 also includes a threaded portion 94, and an annular shoulder 96 (FIG. 1D) at the second end 86 of the lower housing 16, the functions of which will be explained below. The lower housing 16 may also be provided with a quick disconnect profile, as will be discussed more fully below.

Referring to FIG. 1A, the slips 18*a* and 18*b* include inner surfaces 98*a* and 98*b*, flared ends 100*a* and 100*b*, and T-shaped ends 102*a* (FIG. 6) and 102*b*. The flared ends 100*a* and 100*b* mate with the flared portion 50 of the loading nut 12. In a specific embodiment, the flared ends 100*a* and 100*b* may be inwardly flared at approximately 3-degree angles. The inner surfaces 98*a* and 98*b* of the flared ends 100*a* and 100*b* include gripping teeth 104*a* and 104*b* for gripping the coiled tubing 11.

Figure 1B:
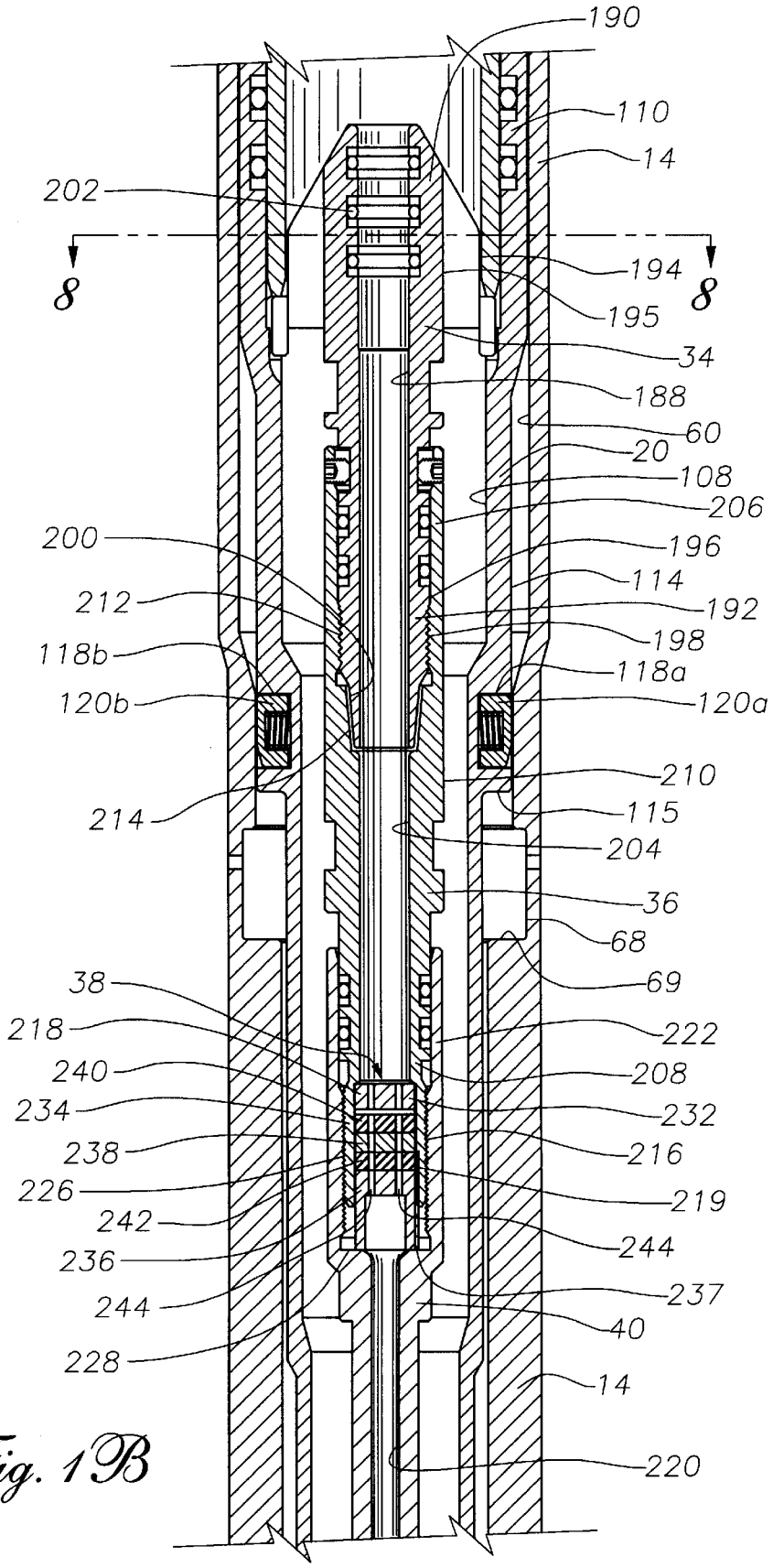
Figure 6:
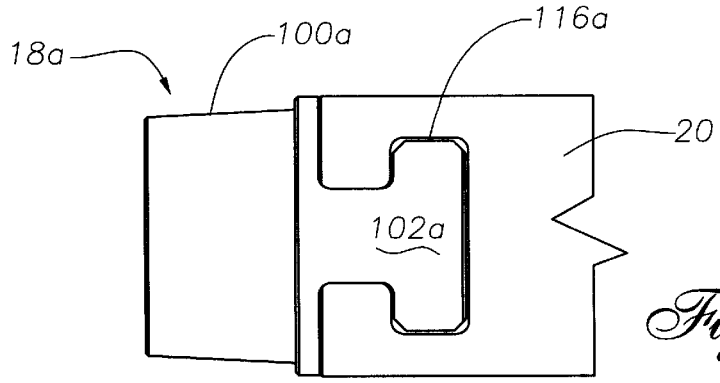
FIG. 6 is a partial elevation view of the emergency release tool, taken along line 6—6 of FIG. 1A, with a portion of the tool removed to illustrate a T-shaped interconnection of a first slip and a slip case.

The slip case 20 includes a longitudinal bore 108 extending therethrough, a first end 110, a second end 112, and an outer surface 114. As shown in FIG. 6, the first end 110 includes T-shaped slots 116*a* and 116*b* for receiving the T-shaped ends 102*a* and 102*b*, respectively, of the slips 18*a* and 18*b*. The outer surface 114 of the slip case 20 includes a shoulder 115 (FIG. 1B) and first and second recesses 118*a* and 118*b*, disposed adjacent the shoulder 115, for receiving first and second spring-loaded locking dogs 120*a* and 120*b*. The locking dogs 120*a* and 120*b* are shown in a compressed state, but, when the tool 10 is shifted to its released position—not shown, but to be more fully explained below—the shoulder 115 on the slip case 20 engages the shoulder 69 on the slip housing 14, and the locking dogs 120*a* and 120*b* move radially outwardly under the force of springs 122*a* and 122*b* to engage the annular recess 68 in the slip housing 14. As shown in FIG. 1D, the outer surface 114 adjacent the second end 112 of the slip case 20 includes a threaded portion 122, the function of which will be explained below.

Figure 1C:
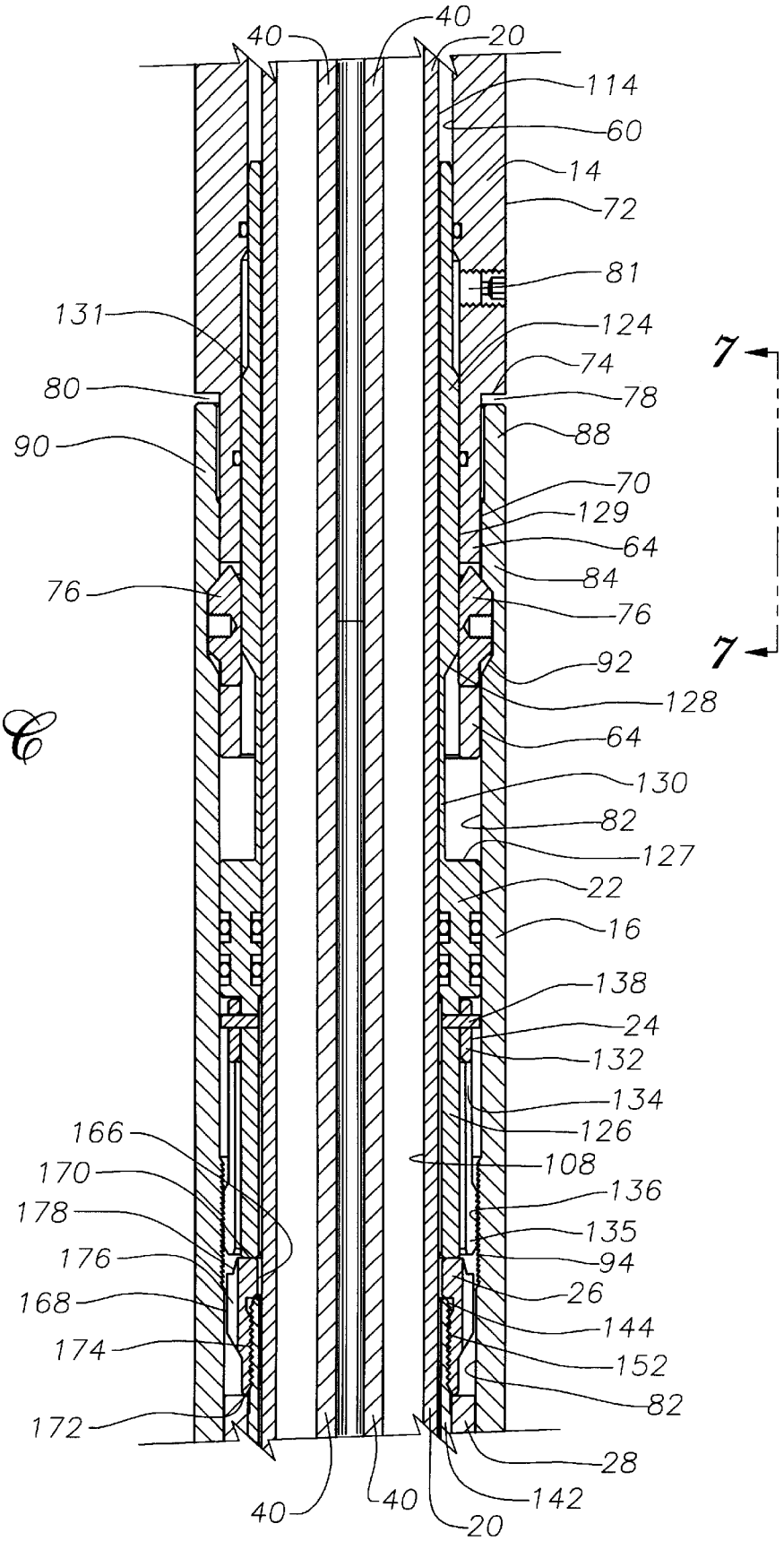
Figure 1D:
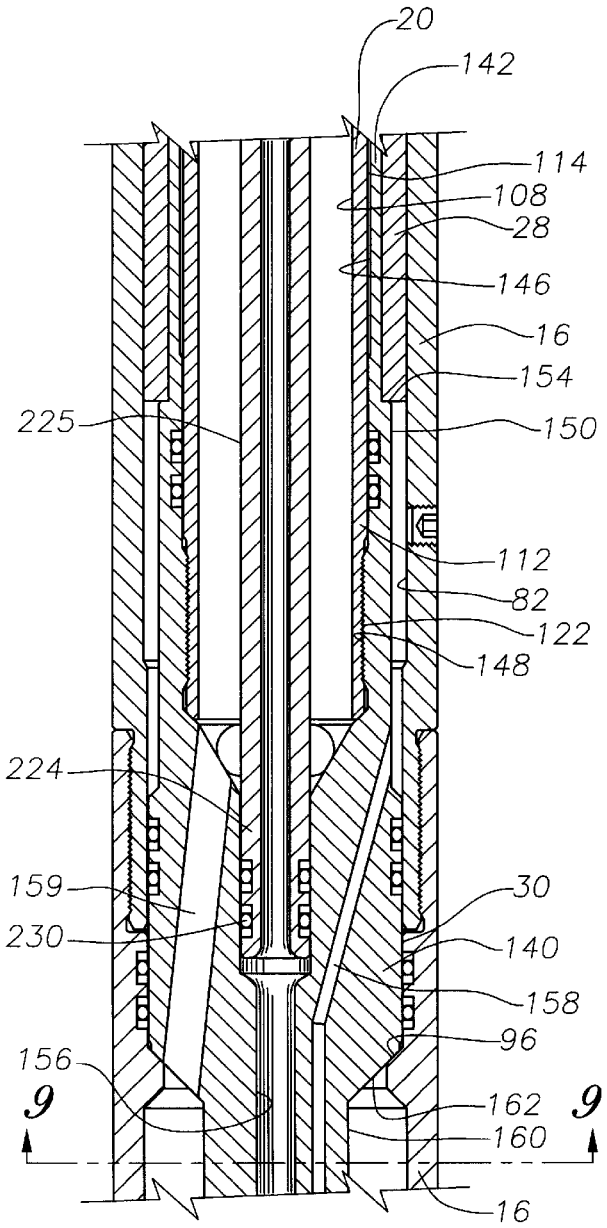

Referring to FIG. 1C, the piston 22 is disposed for longitudinal movement around the slip case 20 and within the longitudinal bore 82 of the lower housing 16. The piston 22 includes a first extension 124, a second extension 126, and a first shoulder 127 adjacent the first extension 124. The first extension 124 is disposed for longitudinal movement around the slip case 20 and within the longitudinal bore 60 of the slip housing 14, and includes an inclined surface 128 connecting an area of increased diameter 129, an area of reduced diameter 130, and a shoulder 131 disposed beneath the aperture 81 in the slip housing 14. Well bore pressure is applied through the aperture 81 to the shoulder 131 to maintain a downward force on the piston 22 to counteract any upward forces on the piston 22—other than the forces generated as a result of the ignition of the propellant 28—that may develop during the drilling process. The second extension 126 is disposed for longitudinal movement around the slip case 20 and within the longitudinal bore 82 of the lower housing 16. When the tool 10 is in its locked position (as shown), the at least one dog 76 in the second end 64 of the slip housing 14 is held firmly within the annular recess 92 in the lower housing 16 by the area of increased diameter 129 on the first extension 124 of the piston 22, which thereby holds the slip housing 14 and the lower housing 16 together in tension. When the tool 10 is being shifted to its released position (not shown), the piston 22 is urged upwardly—under action of the propellant 28, as will be discussed more fully below—so that the shoulder 127 on the piston 22 engages the second end 64 of the slip housing 14, and the at least one dog 76 on the slip housing 14 moves inwardly along the inclined surface 128 and into the area of reduced diameter 130, thereby disconnecting the slip housing 14 from the lower housing 16. As will be more fully discussed below, the piston 22 then forces the slip housing 14 upwardly to separate the loading nut 12 from the slips 18*a* and 18*b*, and thereby disengage the emergency release tool 10 from the coiled tubing 11.

With reference to FIG. 1C, the collet 24 is disposed around the second extension 126 of the piston 22 and within the longitudinal bore 82 of the lower housing 16, and includes a body portion 132 having a plurality of fingers 134 depending therefrom. Distal ends 135 of the fingers 134 each include a threaded portion 136 for mating with the threaded portion 94 in the longitudinal bore 82 of the lower housing 16. When the tool 10 is in the locked position (as shown), the threaded portions 136 on the collet fingers 134 are engaged with the threaded portion 94 in the longitudinal bore 82 of the lower housing 16, and the collet body 132 is releaseably secured to the second extension 126 of the piston 22, for example, by at least one shear pin 138. The function and operation of the collet 24 will be explained below.

Figure 1E:
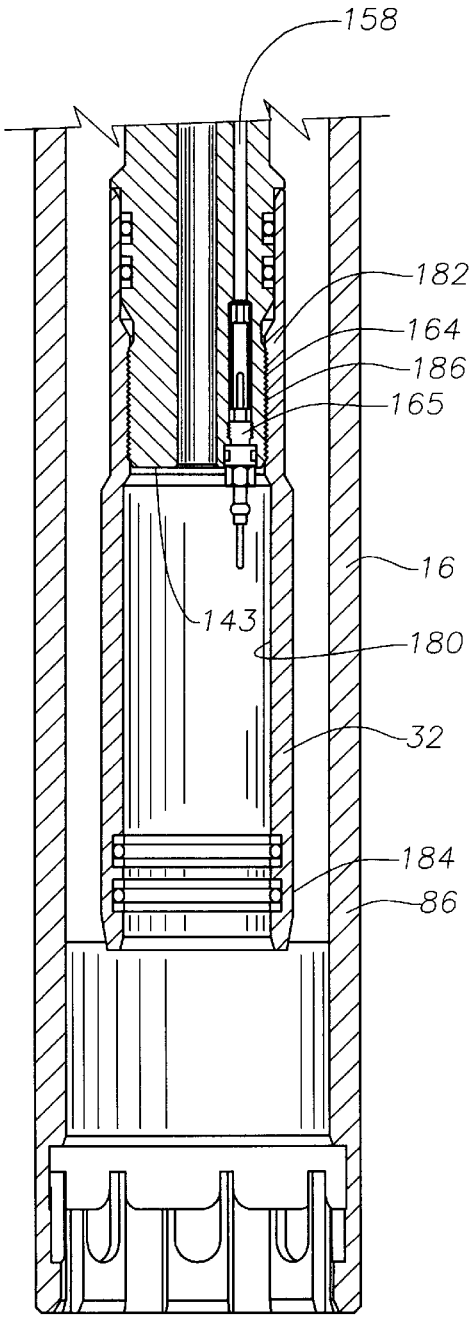

Referring to FIG. 1D, the charge mandrel 30 is disposed within the longitudinal bore 82 of the lower housing 16, and includes a main body portion 140, a first extension 142, and a lower end 143 (FIG. 1E). The first extension 142 includes a longitudinal bore 146 extending therethrough having a threaded portion 148 for mating with the threaded portion 122 at the second end 112 of the slip case 20. The first extension 142 also includes an outer surface 150 having a threaded portion 152 (FIG. 1C) at a distal end 144 of the first extension 142, and a propellant retaining shoulder 154 (FIG. 1D), the functions of which will be explained below. The main body portion 140 includes a longitudinal bore 156 extending therethrough, an electrical conductor conduit 158, at least one drilling fluid flowpath 159, an outer surface 160 having a loading shoulder 162 for bearing against the annular load bearing shoulder 96 in the longitudinal bore 82 of the lower housing 16, and a threaded portion 164 (FIG. 1E) at the lower end 143 of the charge mandrel 30. An electrical connector 165, such as a single-pin feed-through bulkhead connector, may be disposed in the electrical conductor conduit 158 at the lower end 143 of the charge mandrel 30. As will be more fully explained below, one of the electrical conductors (not shown) in the conductor cable (not shown) running from the earth's surface (not shown) to the tool 10 is connected to the electrical connector 165, and another electrical conductor (not shown) connects the electrical connector 165 to the propellant 28 (FIG. 1D) so that the propellant 28 may be remotely ignited from the earth's surface via the conductor cable.

Referring to FIG. 1C, the propellant retainer ring 26 is an annular ring having a longitudinal bore 166 extending therethrough, an outer surface 168, a first edge 170, and a second edge 172. The longitudinal bore 166 includes a threaded portion 174 for mating with the threaded portion 152 on the first extension 142 of the charge mandrel 30. The outer surface 168 preferably includes at least one recess 176 to facilitate the passage of gases generated upon ignition of the propellant 28, as will be more fully explained below. However, since the retainer ring 26 is not sealed, the propellant gases will still expand past the ring 26 in the absence of any recess 176. The outer surface 168 also includes a locking shoulder 178 adjacent the first edge 170 of the ring 26 for loading the collet 24, as will be more fully explained below. The ring 26 is disposed around the outer surface 150 of the first extension 142 of the charge mandrel 30 and extends past the distal end 144 of the first extension 142. As shown in FIGS. 1C and 1D, when the tool 10 is in the locked position (as shown), the propellant 28 is disposed between the longitudinal bore 82 of the lower housing 16 and the outer surface 150 of the first extension 142 of the charge mandrel 30, and is held in place between the second edge 172 of the ring 26 and the retaining shoulder 154 on the charge mandrel 30.

Referring to FIG. 1E, the extension 32 includes a longitudinal bore 180 extending therethrough, a first end 182, and a second end 184. The longitudinal bore 180 includes a threaded portion 186 for mating with the threaded portion 164 adjacent the lower end 143 of the charge mandrel 30. An upper portion of an uppermost tool in the bottom hole assembly (not shown) may be sealably received within the longitudinal bore 180 at the second end 184 of the extension 32.

As discussed above, a conductor cable (not shown) runs from a control panel (not shown) at the earth's surface (not shown) through the coiled tubing 11, through the tool 10, and down to the various tools in the bottom hole assembly (not shown) to which the tool 10 is connected. Drilling fluid also flows from the earth's surface (not shown) through the coiled tubing 11, through the tool 10, and down through the bottom hole assembly (not shown). The tool 10 may be provided with a sealing assembly—consisting of the anchor 34, the armor nut 36, the conductor cable sealing connector 38, and the flow tube 40—to seal the electrical conductors within the conductor cable (not shown) from the drilling fluid. While the conductor cable has not been shown, it will be understood by those of ordinary skill in the art that one specific embodiment of a conductor cable may include a number of electrical conductors that are encased first by an armor, and then by an outer protective shell. In another specific embodiment, the conductor cable may include fiber optic conductors.

Figure 8:
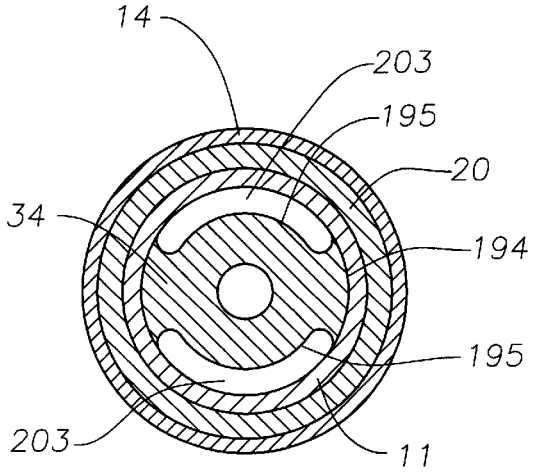
FIG. 8 is a cross-sectional view taken along line 8—8 of FIG. 1B.
Figure 9:
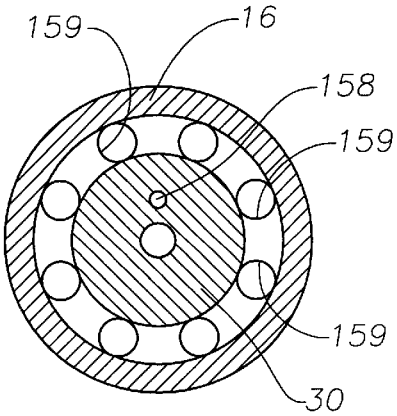
FIG. 9 is a cross-sectional view taken along line 9—9 of FIG. 1D.
Figure 10A:
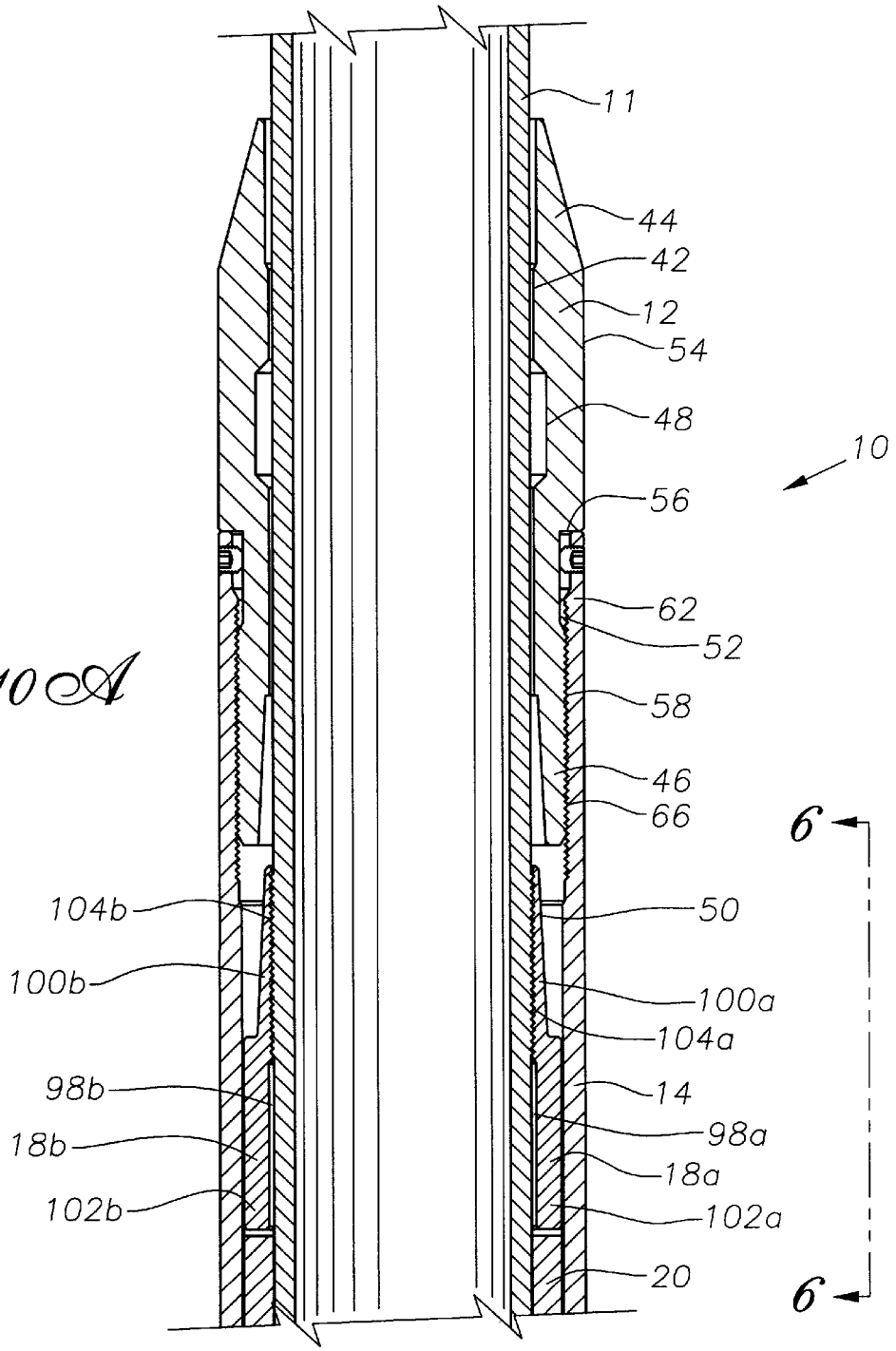
FIGS. 10A–10E illustrate a longitudinal cross-sectional view of the assembly illustrated in FIGS. 1A–1E in a released position.
Figure 10B:
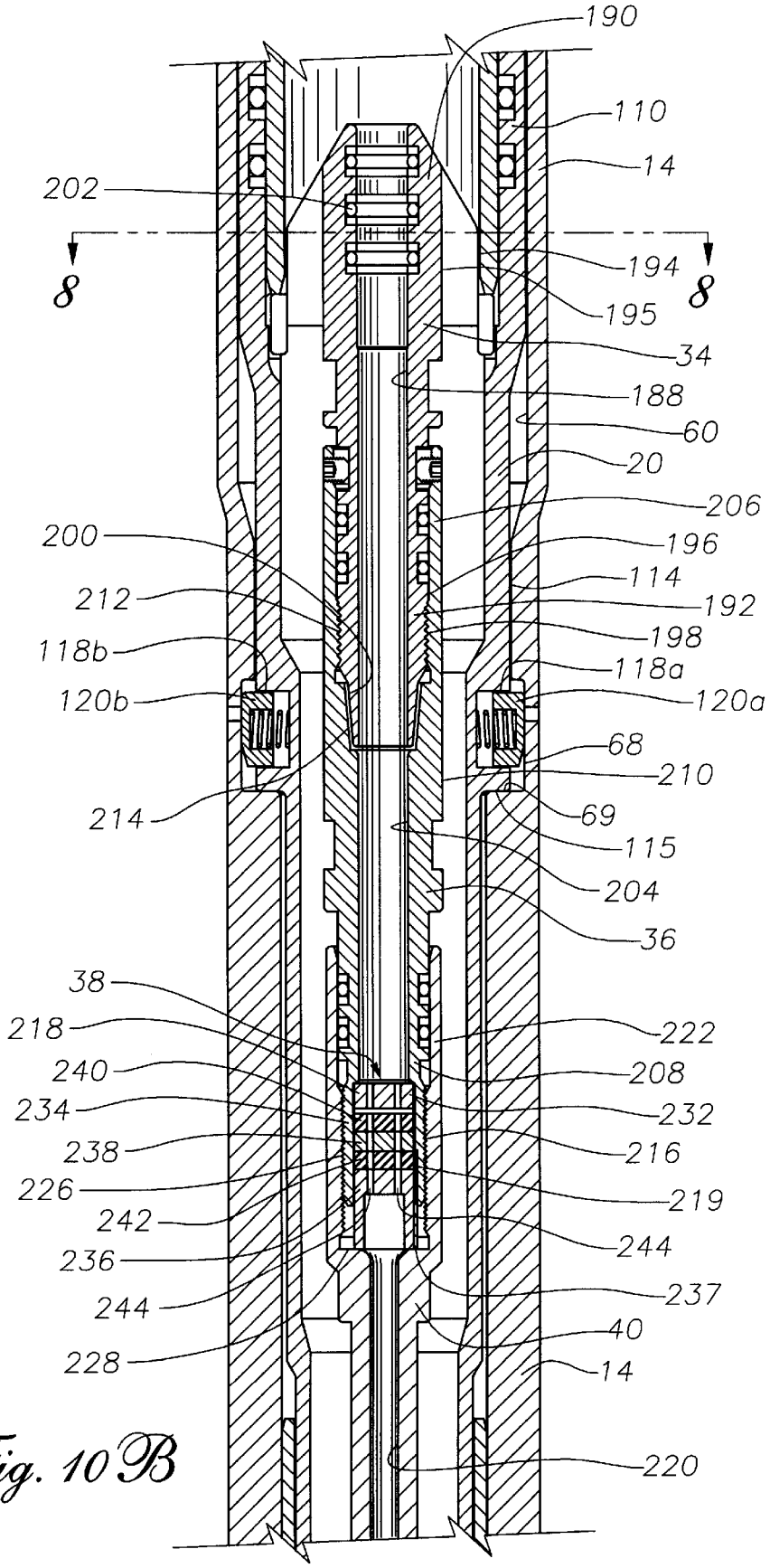
Figure 10C:
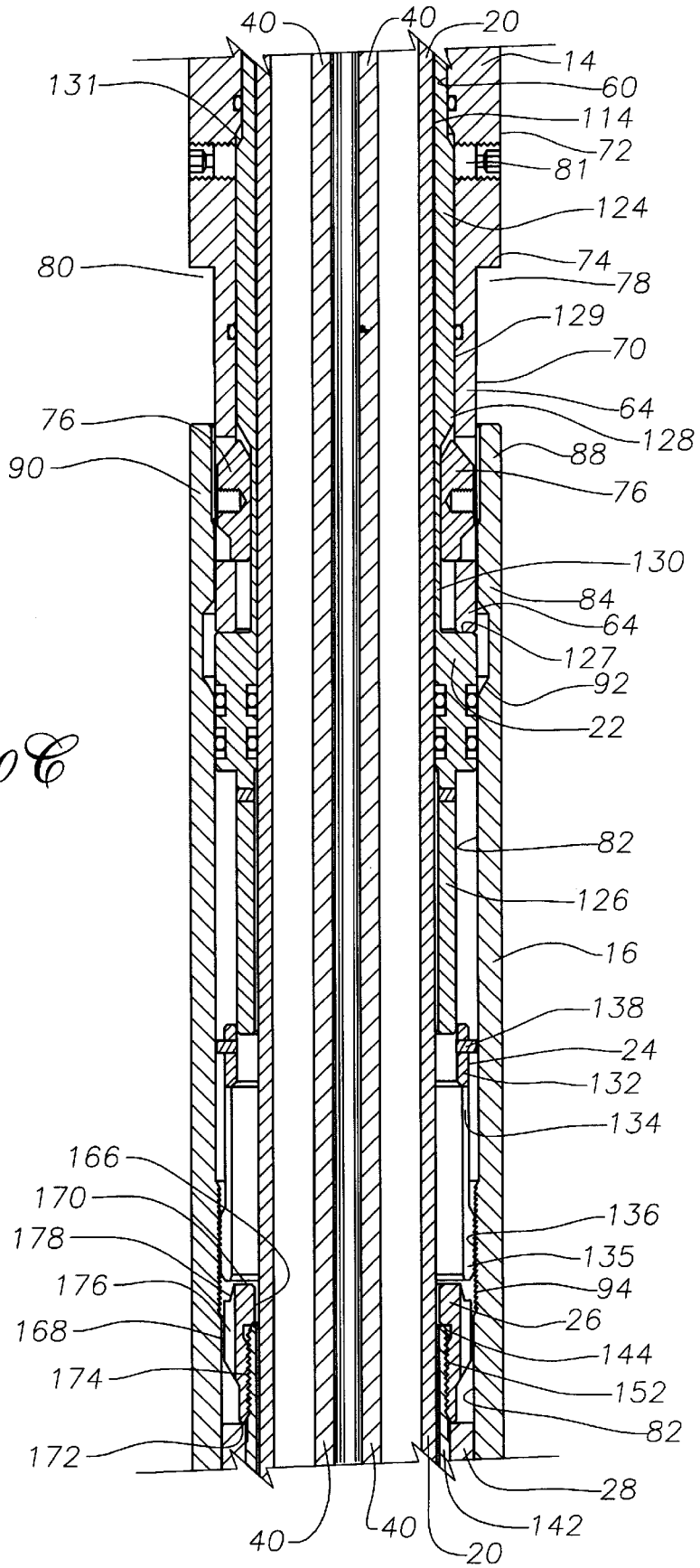
Figure 10D:
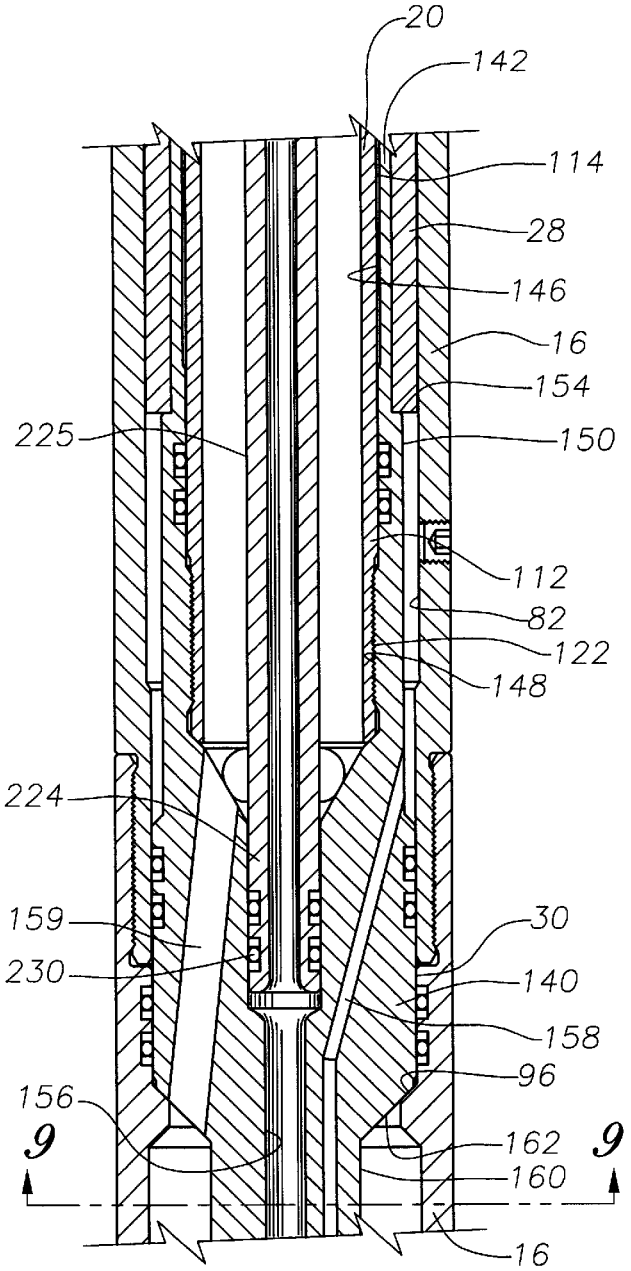
Figure 10E:
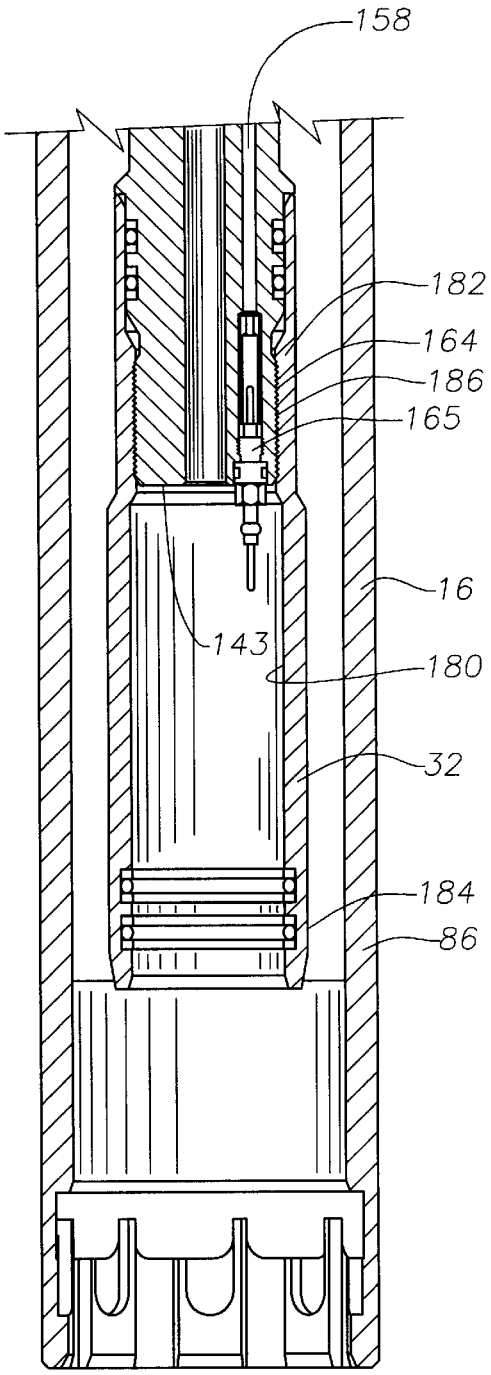

Referring to FIG. 1B, the anchor 34 includes a longitudinal bore 188 extending therethrough, a first end 190, a second end 192, a first outer surface 194 adjacent the first end 190, a second outer surface 195 adjacent the first end 190, and an outer surface 196 adjacent the second end 192. The outer surface 196 at the second end 192 of the anchor 34 includes a threaded portion 198 and an inclined portion 200. The longitudinal bore 188 may include a set of seals 202 for sealing against the outer protective shell of the conductor cable (not shown). As best shown in FIG. 8, which is a cross-sectional view taken along line 8—8 of FIG. 1B, the first outer surface 194 at the first end 190 of the anchor 34 has a diameter approximately equal to the inside diameter of the coiled tubing 11. Drilling fluid flow areas 203 exist between the coiled tubing 11 and the second outer surface 195 at the first end 190 of the anchor 34 to allow drilling fluid to flow past the anchor 34, through the longitudinal bore 108 of the slip case 20, and through the drilling fluid flowpaths 159 (FIG. 1D) in the charge mandrel 30 to the bottom hole assembly (not shown).

With reference to FIG. 1B, the armor nut 36 includes a longitudinal bore 204 extending therethrough, a first end 206, a second end 208, and an outer surface 210. The longitudinal bore 204 includes a threaded portion 212 for mating with the threaded portion 198 on the second end 192 of the anchor 34, and an inclined surface 214 for cooperating with the inclined portion 200 on the second end 192 of the anchor 34 to retain the conductor cable's armor (not shown) in a folded-back position, as will be discussed more fully below. The outer surface 210 includes a threaded portion 216 at the second end 208 of the armor nut 36, the purpose which will be explained below. The longitudinal bore 204 includes an annular shoulder 218 and a keyway 219 at the second end 208 of the armor nut 36 for retaining the conductor cable sealing connector 38, as will be more fully discussed below.

The flow tube 40 includes a longitudinal bore 220 extending therethrough, a first end 222, a second end 224 (FIG. 1D), and an outer surface 225. Referring to FIG. 1B, the longitudinal bore 220 includes a threaded portion 226 for mating with the threaded portion 216 at the second end 208 of the armor nut 36, and an annular shoulder 228 for cooperating with the annular shoulder 218 in the longitudinal bore 204 of the armor nut 36 to retain the conductor cable sealing connector 38. Referring to FIG. 1D, the outer surface 225 of the flow tube 40 may include a set of seals 230 adjacent the second end 224 thereof, which is disposed within the longitudinal bore 156 of the main body portion 140 of the charge mandrel 30.

Referring to FIG. 1B, in a specific embodiment, the conductor cable sealing connector 38 may be a three-part cylindrical plug including a metal carrier plug 232, a composite seal 234, and a metal follower plug 236. In a specific embodiment, the composite seal 234 may include a Teflon™ ring 238 disposed between first and second graphite-impregnated rings 240 and 242, such as those sold under the name Grafoil™. A plurality of longitudinal bores 244 extend through the connector 38 (i.e., through the metal carrier plug 232, the composite seal 234, and the metal follower plug 236). The conductor cable's individual electrical conductors (not shown) pass through the longitudinal bores 244 and into the longitudinal bore 220 of the flow tube 40. The conductor cable's individual conductors (not shown) are sealed by compressing the composite seal 234 between the carrier plug 232 and the follower plug 236, which are forced towards each other by threading the flow tube 40 onto the second end 208 of the armor nut 36. The follower plug 236 includes a key 237 for mating with the keyway 219 in the longitudinal bore 204 at the second end 208 of the armor nut 36. The key 237 and keyway 219 prevent the follower plug 236—and the conductor cable's individual electrical conductors (not shown) that pass through the longitudinal bores 244—from rotating when the flow tube 40 is being threaded onto the armor nut 36. The individual electrical conductors (not shown) extend through the longitudinal bore 220 of the flow tube 40, through the longitudinal bore 156 of the charge mandrel 30, and through the longitudinal bore 180 of the extension 32 to the BHA. As already explained above, one of the individual electrical conductors (not shown) is connected to the electrical connector 165 (FIG. 1E) at the lower end of the charge mandrel 30 for igniting the propellant 28.

The operation of the emergency release tool 10 will now be explained. The tool 10 is connected to the coiled tubing 11 and to the remainder of the BHA at the earth's surface, before being lowered into a wellbore (not shown). As noted above, when attaching the tool 10 to the coiled tubing 11, only deburring of the coiled tubing 11 is necessary for installation. This allows simple and cost effective field assembly to be completed quickly at any time. After the coiled tubing 11 is deburred, the conductor cable is connected to the sealing assembly ( i.e., the anchor 34, the armor nut 36, the conductor cable sealing connector 38, and the flow tube 40), to the electrical connector 165, and to the BHA, in the manner discussed above. The coiled tubing 11 is then inserted into the tool 10 to the position as shown in FIG. 1A. When the coiled tubing 11 is first inserted into the tool 10, the loading nut 12 is in an unloaded or loose position (not shown). At this time, the remainder of the tool 10 is positioned as shown in FIGS. 1A–1E. When properly inserted, the coiled tubing 11 is disposed within the longitudinal bore 42 of the loading nut 12, within the inner surfaces 98*a* and 98*b* of the slips 18*a* and 18*b*, within the longitudinal bore 108 of the slip case 20 at the first end 110 thereof, and around the first outer surface 194 at the first end 190 of the anchor 34 (FIG. 1B). The threads 58 on the loading nut 12 are then threaded into the threads 66 on the slip housing 14. In this manner, the flared portion 50 on the second end 46 of the loading nut 12 is forced downwardly against the corresponding flared ends 100*a* and 100*b* of the slips 18*a* and 18*b*, thereby causing the gripping teeth 104*a* and 104*b* on the slips 18 to securely engage and hold the coiled tubing 11 within the tool 10. To ensure that the slips 18 are loaded onto the coiled tubing 11, the tool 10 is designed so that the shoulder 56 on the loading nut 12 may not come into contact with the first end 62 of the slip housing 14. The second end 86 of the lower housing 16 is then connected to the remainder of the BHA, as by the quick disconnect coupler 246, as shown in FIGS. 2–5, to be discussed below.

If the BHA (not shown) becomes lodged downhole during the drilling operation to the extent that the coiled tubing 11 is not sturdy enough to impart the required force to dislodge the BHA, then the emergency release tool 10 may be remotely activated from the earth's surface (not shown) to release the coiled tubing 11. The release of only the coiled tubing 11 leaves no enlarged or "upset" diameters or areas attached to the coiled tubing 11 to hinder its removal from the well. As discussed above, the coiled tubing 11 is released by sending an electrical signal to ignite the propellant 28, and thereby shift the tool 10 from a locked position (as shown) to a released position as depicted in FIGS. 10A–10E. When the propellant 28 is ignited, tremendous forces are generated by expanding gas pressure. The expanding gas pressure travels through the at least one recess 176 in the propellant retainer ring 26 and forces the piston 22 upwardly, thereby shearing the at least one shear pin 138 and releasing the piston 22 from the collet 24, which is attached by threads 94 and 136 to the lower housing 16. The expanding gas pressure continues to force the piston 22 upwardly. As the shoulder 127 on the piston 22 engages the second end 64 of the slip housing 14, the at least one dog 76 on the slip housing 14 moves inwardly along the inclined surface 128 and into the area of reduced diameter 130, thereby relieving tension between the slip housing 14 and the lower housing 16. At this point, the lower housing 16 may shift downwardly to cause the distal ends 135 of the collet fingers 134 to abut against the locking shoulder 178 on the propellant retainer ring 26. The expanding gas pressure continues to force the piston 22 and the slip housing 14 upwardly to separate the loading nut 12 from the slips 18*a* and 18*b*, and thereby disengage the emergency release tool 10 from the coiled tubing 11. As the tool 10 is shifted to its released position, the shoulder 69 on the slip housing 14 engages the shoulder 115 on the slip case 20, and the locking dogs 120*a* and 120*b* on the slip case 20 move radially outwardly under the force of springs 122*a* and 122*b* to engage the annular recess 68 in the slip housing 14, thereby preventing the loading nut 12 from causing the slips 18 to re-engage the coiled tubing 11. The coiled tubing 11 and conductor cable (not shown) may then be removed from the tool 10, thereby exposing the fishing profile 48 (discussed above) on the loading nut 12. When the coiled tubing 11 and conductor cable are pulled from the tool 10, the sealing assembly (i.e., the anchor 34, the armor nut 36, the conductor cable sealing connector 38, and the flow tube 40) is also pulled from the tool 10.

A conventional tubing string (not shown), that is more robust and capable of withstanding far greater tensile loads than the coiled tubing 11, equipped with a conventional well tool (not shown) may be used to engage the fishing profile 48 to pull the tool 10 and BHA from the well. The upward force of the tubing string is transferred to the BHA via (1) the shoulder 69 on the slip housing 14 which is bearing against the shoulder 115 on the slip case 20, and (2) the locking shoulder 178 on the propellant retainer ring 26 which is bearing against the distal ends 135 of the collet fingers 134; the load is transferred from the collet fingers 134 through the threaded portions 94 and 136 to the lower housing 16 and on to the BHA. The threaded portions 94 and 136 are designed to fail at a preselected load. If that failure load is exceeded, the collet 24 will become disengaged from the lower housing 16, and all parts of the tool 10 will be removed, except for the lower housing 16, which will remain attached to the BHA. At this point, a second attempt at removing the BHA using a conventional tubing string and well tool may made. Under this scenario, the annular recess 92 and/or the annular load bearing shoulder 96, both in the longitudinal bore 82 of the lower housing 16, may function as "fishing" profiles. The lower housing 16 is designed to withstand greater pulling forces than the collet 24 or the related threaded portions 136 and 94.

In the event the tool 10 malfunctions or the coiled tubing 11 becomes stuck, conventional well tools may be used to cut the coiled tubing 11 at a point near the tool 10. To do this, the conductor cable (not shown) must be removed from the interior of the coiled tubing 11. The conductor cable is removed by simply pulling it with sufficient force to shear the armor that has been folded back between the inclined portion 200 of the anchor 34 and the inclined surface 214 of the armor nut 36. After the conductor cable has been removed, a conventional well tool may be lowered into the interior of the coiled tubing 11 to cut the coiled tubing 11 near the tool 10, in any manner known to those of ordinary skill in the art. The portion of the coiled tubing 11 above the cut may then be removed, and another conventional well tool may be lowered into the well to fish the remaining portion of the coiled tubing 11 from the well, in any manner known to those of ordinary skill in the art.

Figure 2:
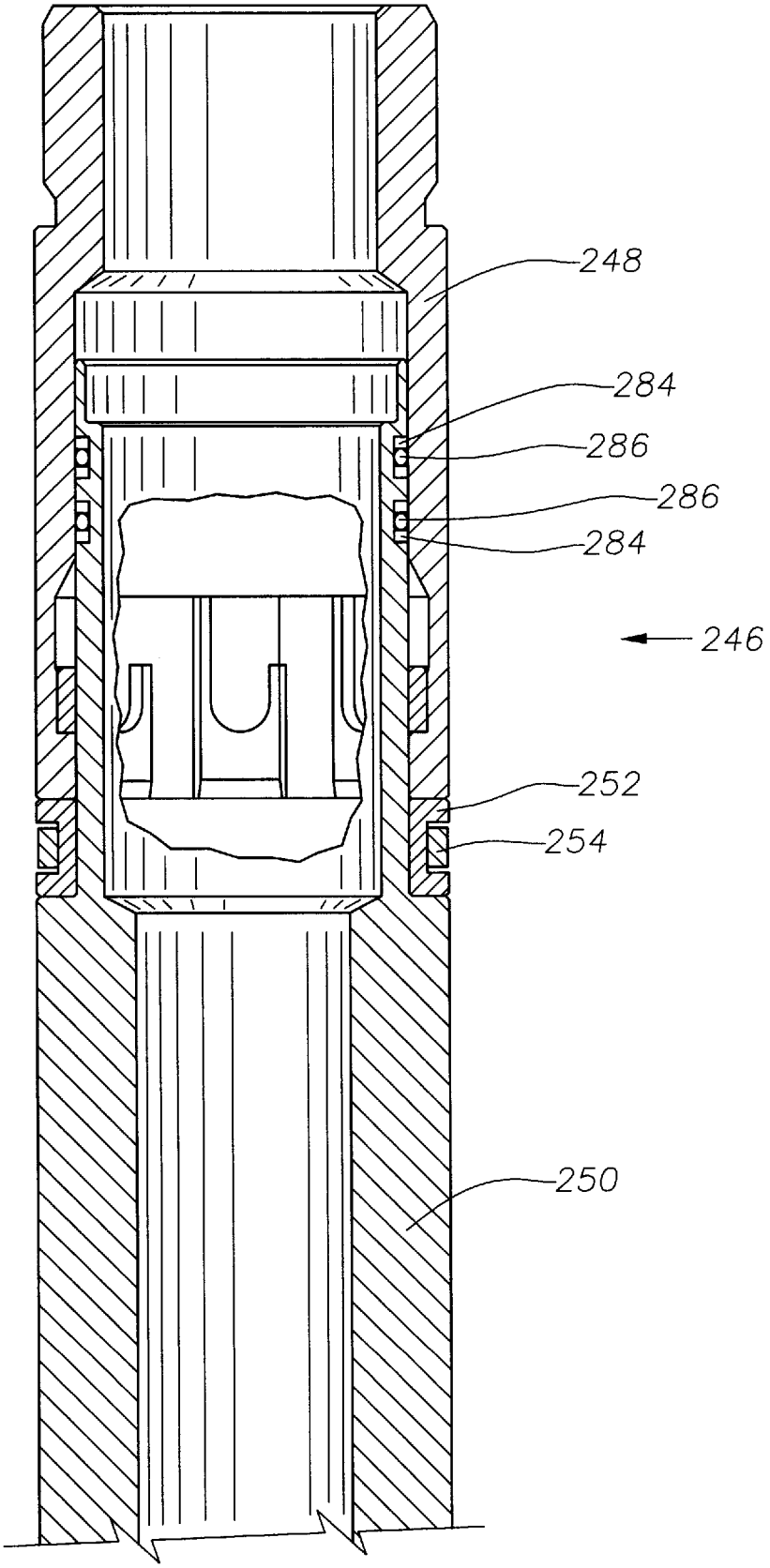
FIG. 2 is a longitudinal cross section of an assembly of a quick disconnect coupler of the present invention.

With reference to FIGS. 2–5, the quick disconnect coupler 246 of the present invention will now be described. As shown in FIG. 2, in a broad aspect, the quick disconnect coupler 246 includes a box (or female) connector 248, a pin (or male) connector 250, a two-part load ring (or rigid spacer) 252, and a load ring retainer 254.

Figure 3:
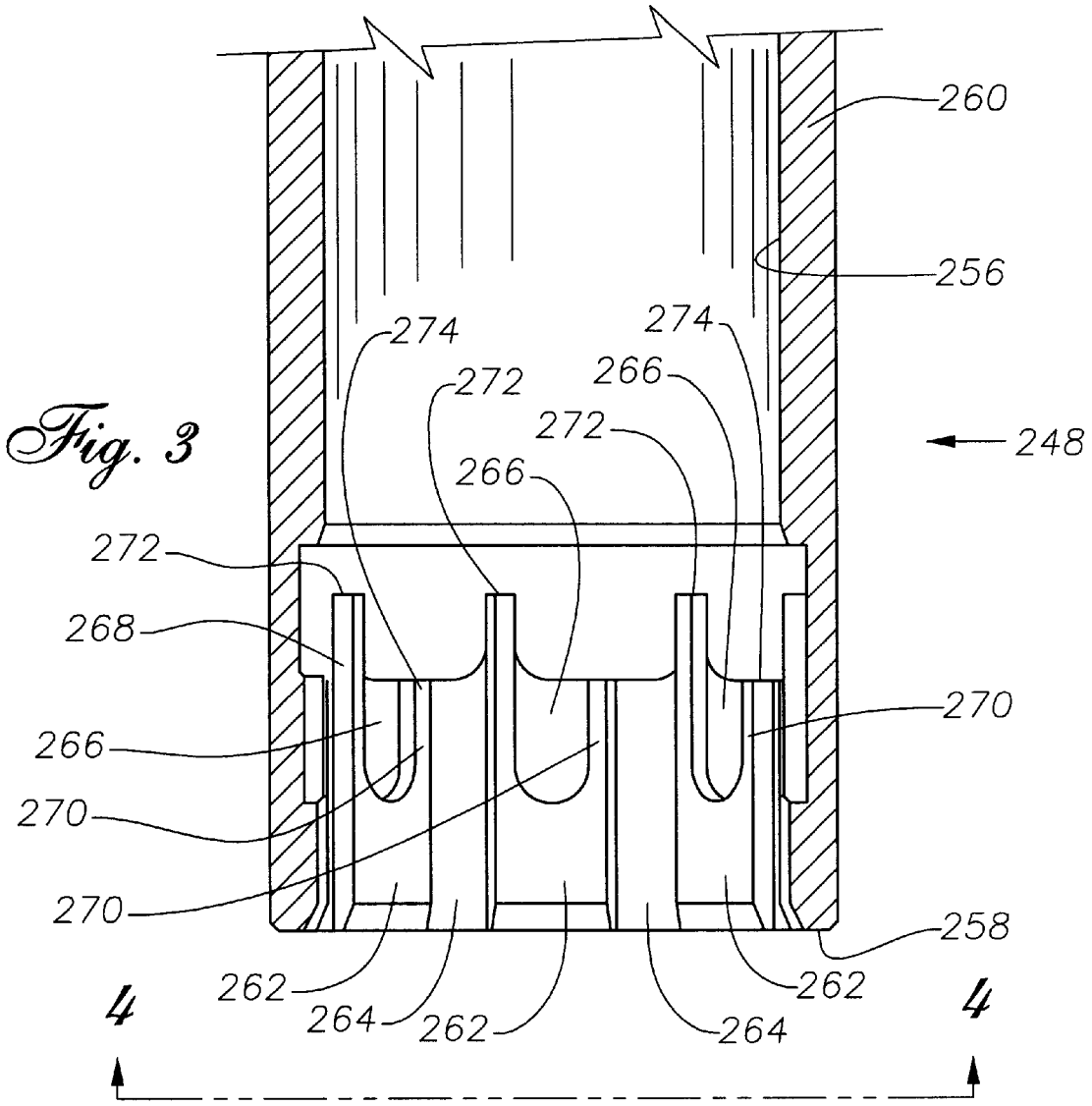
FIG. 3 is a longitudinal cross-sectional view of a box or female end of the quick disconnect coupler shown in FIG. 2.
Figure 4:
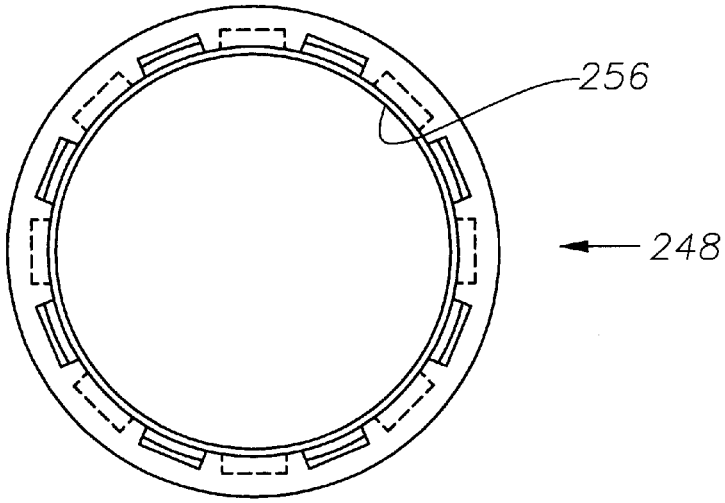
FIG. 4 is cross-sectional view of the box or female end of the quick disconnect coupler taken along line 4—4 of FIG. 3.

As shown in FIGS. 3 and 4, the box/female connector 248 includes a longitudinal bore 256 extending therethrough, a first end 258, and a second end 260. At the first end 258 of the box/female connector 248, the longitudinal bore 256 includes a plurality of ribs 262 that are preferably evenly spaced about the circumference of the longitudinal bore 256, and a plurality of grooves 264 defined between the ribs 262. Each rib 262 includes a recess 266 disposed between a first leg 268 and second leg 270. The first leg 268 includes a distal end 272 and the second leg 270 includes a distal end 274. The distal end 274 of the second leg 270 is located closer to the first end 258 of the box/female connector 248 than is the distal end 272 of the first leg 268.

Figure 5:
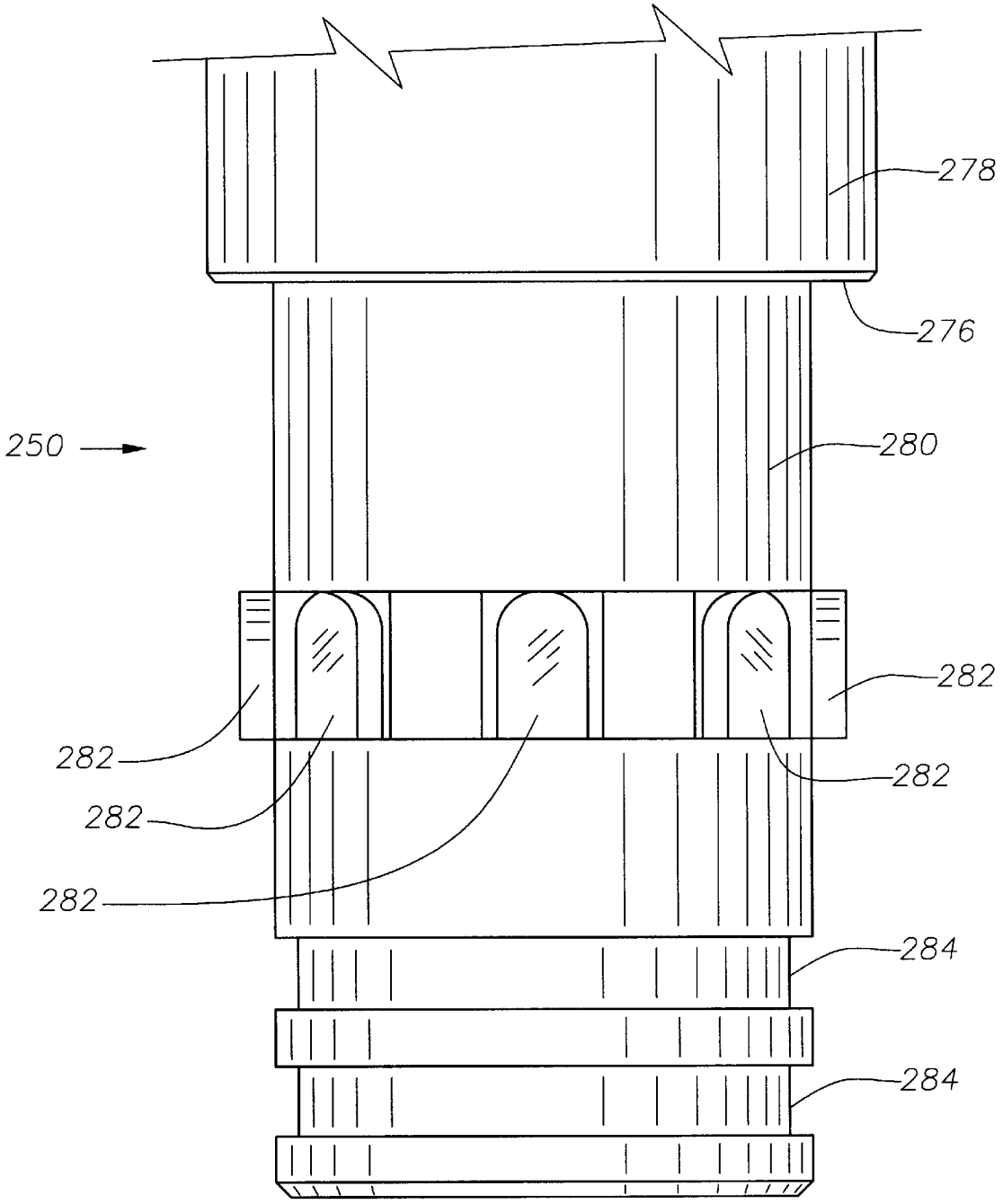
FIG. 5 is a longitudinal view of a pin or male end of the quick disconnect coupler shown in FIG. 2.

As shown in FIG. 5, the pin/male connector 250 includes a shoulder 276 adjacent a main body portion 278 and a pin member 280. The pin member 280 includes a plurality of lugs 282 for mating with the recesses 266 in the ribs 262 on the box/female connector 248 (FIG. 3), as will be more fully explained below. The pin member 280 further includes at least one seal groove 284 for receiving a sealing ring 286, as shown in FIG. 2.

The purpose of the quick disconnect coupler 246 is to enable various downhole tools, such as the emergency release tool 10 or the individual component tools that make up a BRA (not shown), to be quickly and efficiently connected and disconnected. The quick disconnect coupler 246 achieves this purpose by connecting, as by threads, the box/female connector 248 to one end of a first tool (not shown) and the pin/male connector 250 to a mating end of a second tool (not shown). Once the tools that are desired to be connected are equipped with the connectors 248 and 250, the tools may be quickly connected by: (1) sliding the lugs 282 on the pin/male connector 250 into the grooves 264 on the box/female connector 248 until the shoulder 276 on the pin/male connector 250 abuts against the first end 258 of the box/female connector 248, and the lugs 282 extend past the distal ends 274 of the second legs 270 of the ribs 262; (2) rotating the pin/male connector 250 a fraction of a full 360 degree turn until the lugs 282 contact the first legs 268 on the ribs 262 and are positioned adjacent their corresponding recesses 266; (3) sliding the lugs 282 into their corresponding recesses 266; and (4) fastening the load ring 252 around the pin member 280, and between the shoulder 276 on the pin/male connector 250 and the first end 258 of the box/female connector 248. The pin/male connector 250 and the box/female connector 248 may be alternately locked and unlocked by a rotation of either connector. The load ring 252 prevents the lugs 282 from exiting the recesses 266 and also transmits compressive loads through the connection. The lugs 282 and ribs 262 transmit all tensile and torque forces through the connection. The sealing rings 286 maintain a fluidic pressure seal between the box/female connector 248 and the pin/male connector 250. As noted above, this connection allows minimal rotation of parts being assembled, eases and quickens repair or replacement of components, provides a universal profile to simplify custom configurations, and enables a beneficial modularity whereby specific devices may be added, removed, or changed in relative position in the BHA.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

We claim:

1. An emergency release tool comprising:

a releasable slip for holding a coiled tubing, the releasable slip being secured to a first end of a slip case, the slip case being disposed within a slip housing and a lower housing, the slip housing being movable from a locked position to a released position;

a piston slidably disposed about the slip case and being moveable from a locked position to a released position;

a first end of the lower housing being releasably connected to a second end of the slip housing when the slip housing is in its locked position; and, a remotely activated mechanism for moving the piston and the slip housing from their locked positions to their released positions to disengage the releasable slip from the coiled tubing and enable the coiled tubing to be removed from the tool.

2. The emergency release tool of claim 1, further including a loading nut movably secured to a first end of the slip housing and mating with the releasable slip for holding the coiled tubing.

3. The emergency release tool of claim 2, wherein the loading nut is threadably secured to the first end of the slip housing.

4. The emergency release tool of claim 2, wherein the loading nut includes a flared portion for mating with a flared portion on the releasable slip.

5. The emergency release tool of claim 4, wherein the flared portions on the loading nut and on the slip are flared at angles of approximately three degrees.

6. The emergency release tool of claim 2, wherein the loading nut includes a fishing profile for engaging a well tool to be used in retrieving the emergency release tool and a bottom hole assembly attached thereto upon the coiled tubing being released from the emergency release tool.

7. The emergency release tool of claim 1, wherein the second end of the slip housing further includes at least one dog and is telescopically received within the first end of the lower housing, the piston holding the at least one dog in an annular recess in the first end of the lower housing when the piston is in its locked position to connect the slip housing to the lower housing, and the piston releasing the at least one dog to disconnect the slip housing and the lower housing and moving the slip housing to its released position when the piston is moved from its locked position to its released position.

8. The emergency release tool of claim 7, wherein the annular recess in the lower housing may function as a redundant fishing profile for engaging a well tool to be used in retrieving the emergency release tool and a bottom hole assembly attached thereto upon the coiled tubing being released from the emergency release tool and upon detachment from the tool of the releasable slip, the slip case, the slip housing, and the piston.

9. The emergency release tool of claim 1, wherein the lower housing further includes an annular load bearing shoulder that may function as a redundant fishing profile for engaging a well tool to be used in retrieving the emergency release tool and a bottom hole assembly attached thereto upon the coiled tubing being released from the emergency release tool and upon detachment from the tool of the releasable slip, the slip case, the slip housing, and the piston.

10. The emergency release tool of claim 1, wherein the slip case includes an outer surface having a shoulder and at least one recess for housing at least one locking dog, the at least one locking dog being in a compressed position when the slip housing is in its locked position, and the at least one locking dog being moveable to engage an annular recess within the slip housing when the slip housing is in its released position.

11. The emergency release tool of claim 1, wherein the piston is releasably secured to the lower housing when the piston is in its locked position.

12. The emergency release tool of claim 11, further including a collet being releasably connected to the piston and to the lower housing, the collet being released from the piston when the piston is shifted from its locked position to its released position.

13. The emergency release tool of claim 12, wherein the collet includes a plurality of fingers having threaded portions at distal ends thereof for mating with a threaded portion on the lower housing to releasably secure the collet to the lower housing.

14. The emergency release tool of claim 12, wherein the collet is releasably secured to the piston by a shear pin.

15. The emergency release tool of claim 13, wherein the slip case further includes a locking shoulder for loading the distal ends of the collet fingers when a well tool is being used to engage a fishing profile on the tool to retrieve the tool and an attached bottom hole assembly.

16. The emergency release tool of claim 1, wherein the remotely activated means includes a propellant that, when ignited, forces the piston and the slip housing from their locked positions to their released positions.

17. The emergency release tool of claim 16, wherein the propellant is disposed about the slip case and beneath the piston, and is remotely ignited by an electrical signal.

18. The emergency release tool of claim 1, wherein the remotely activated means includes a gas that, when released, forces the piston and the slip housing from their locked positions to their released positions.

19. The emergency release tool of claim 1, wherein the remotely activated means is connected to and activated by a conductor cable running through the coiled tubing from the earth's surface to the tool.

20. The emergency release tool of claim 19, wherein the conductor cable may be remotely detached from the emergency release tool and removed from the coiled tubing so that conventional well tools may be used to remove the emergency release tool and a bottom hole assembly attached thereto from the well.

21. The emergency release tool of claim 19, further including means for sealing individual conductors within the conductor cable from drilling fluid being circulated through the tool.

22. The emergency release tool of claim 21, wherein the conductor sealing means includes:

an anchor, an armor nut, a conductor cable sealing connector, and a flow tube;

the anchor being received within the coiled tubing and removably connected to the armor nut;

the anchor and the armor nut having cooperating inclined surfaces for holding an armor portion of the conductor cable;

the conductor cable sealing connector having a plurality of longitudinal bores extending therethrough and including a carrier plug, a composite seal, and a follower plug, the composite seal being disposed between the carrier plug and the follower plug, and each of the individual conductors passing through one of the plurality of longitudinal bores; and, a first end of the flow tube being connected to the armor nut to compress the sealing connector between a shoulder on the flow tube and a shoulder on the armor nut and to compress the composite seal and seal the individual conductors from the drilling fluid, and a second end of the flow tube being received within a longitudinal bore of the inner mandrel.

23. The emergency release tool of claim 22, wherein the conductor cable may be remotely detached from the tool by shearing the armor from between the anchor and the armor nut and removed from the coiled tubing so that conventional well tools may be used to remove the emergency release tool and a bottom hole assembly attached thereto from the well.

24. The emergency release tool of claim 1, wherein the piston includes a shoulder disposed beneath an aperture in the slip housing, whereby well bore pressure is applied through the aperture to the piston shoulder to maintain a downward force on the piston to counteract any upward forces on the piston that may develop during the drilling process, other than forces generated as a result of the activation of the remotely activated means.

25. The emergency release tool of claim 1, wherein the tool releases the coiled tubing in a nondestructive manner so as to leave no enlarged diameters on the tubing that could interfere with removal of the coiled tubing from a well.

26. The emergency release tool of claim 1, wherein, upon activation of the remotely activated means to disengage the coiled tubing from the tool, no part of a conductor sealing means within the tool is larger than an outer diameter of the coiled tubing, so that removal of the conductor sealing means from the tool will not interfere with removal of the coiled tubing from a well.

27. The emergency release tool of claim 1, wherein the coiled tubing is released from the tool solely by remote activation of the remotely activated means without mechanical manipulation of the emergency release tool by a well tool.

28. The emergency release tool of claim 1, wherein the coiled tubing is released from the tool solely by remote activation of the remotely activated means without movement of the coiled tubing.

29. The emergency release tool of claim 1, wherein the coiled tubing is released from the tool solely by remote activation of the remotely activated means without movement of a bottom hole assembly connected to the emergency release tool.

30. The emergency release tool of claim 1, wherein the coiled tubing need only be deburred to be installed adjacent the releasable slip.

31. The emergency release tool of claim 1, wherein a quick disconnect coupler is attached to a second end of the lower housing, the quick disconnect coupler including a pin connector having a series of lugs, a box connector for receiving the pin connector and having a series of recesses to engage and hold the lugs, a rigid spacer between the box and pin connectors for transmitting operating loads through the connection, and an integral sealing means for maintaining a fluidic pressure seal between the pin and box connectors.

32. An emergency release tool comprising:

a loading nut having a longitudinal bore extending therethrough, a first end, and a second end having an outer surface, the longitudinal bore having a flared portion at the second end of the loading nut, and the outer surface of the second end having a threaded portion;

a slip housing having a longitudinal bore extending therethrough, a first end, and second end, the longitudinal bore having a threaded portion at the first end of the slip housing for mating with the threaded portion on the loading nut and an annular recess forming a shoulder, and the second end of the slip housing having at least one dog;

a lower housing having a longitudinal bore extending therethrough, a first end, and second end, the second end of the slip housing being telescopically received within the longitudinal bore of the lower housing at the first end thereof, and an annular recess at the first end of the lower housing for receiving the at least one dog in the second end of the slip housing;

a slip case having a longitudinal bore extending therethrough, a first end, a second end, and an outer surface, the outer surface having a shoulder and at least one recess, the at least one recess housing at least one locking dog;

at least one slip connected to the first end of the slip case and having a flared end for mating with the flared end of the loading nut and an inner surface, the inner surface having gripping teeth for gripping a coiled tubing;

a piston disposed for longitudinal movement around the slip case and being releasably secured to the lower housing when the tool is in a locked position, the at least one dog in the second end of the slip housing being held within the annular recess in the lower housing by the piston when the tool is in the locked position, the piston being movable to release the at least one dog from the annular recess when the tool is being shifted from its locked position to a released position; and a remotely activated mechanism for moving the tool from its locked position to its released position to disengage the at least one slip from the coiled tubing.

33. The emergency release tool of claim 32, further including a collet being releasably connected to the piston and to the lower housing, the collet being released from the piston when the tool is shifted from its locked position to its released position.

34. The emergency release tool of claim 33, wherein the collet is releasably secured to the piston by at least one shear pin.

35. The emergency release tool of claim 33, wherein the collet further includes a body portion having a plurality of fingers depending therefrom, the fingers having distal ends, the distal ends having a threaded portion engaged with a threaded portion in the longitudinal bore of the lower housing.

36. The emergency release tool of claim 35, wherein the collet is disposed around a second extension of the piston and within the longitudinal bore of the lower housing, and the collet body is releasably secured to the second extension of the piston.

37. The emergency release tool of claim 32, wherein the remotely activated means includes a gas that, when released, moves the tool from its locked position to its released position.

38. The emergency release tool of claim 32, wherein the remotely activated means includes a propellant that, when ignited, moves the tool from its locked position to its released position.

39. The emergency release tool of claim 38, wherein the propellant is disposed about the slip case and beneath the piston, and is remotely ignited by an electrical signal.

40. The emergency release tool of claim 38, further including:

a charge mandrel having a main body portion and a first extension, the charge mandrel being connected to the second end of the slip case and disposed within the longitudinal bore of the lower housing, the first extension having a distal end and a propellant retaining shoulder, the main body portion having a loading shoulder for bearing against an annular load bearing shoulder in the longitudinal bore of the lower housing; and, a propellant retainer ring having an outer surface, a first edge, and a second edge, the retainer ring being movably connected to the distal end of the first extension of the charge mandrel, the propellant being disposed between the longitudinal bore of the lower housing and an outer surface of the first extension of the charge mandrel, and being held in place between the second edge of the ring and the retaining shoulder on the charge mandrel when the tool is in its locked position.

41. The emergency release tool of claim 40, wherein the outer surface of the propellant retainer ring includes at least one recess to facilitate the passage of gases generated upon ignition of the propellant.

42. The emergency release tool of claim 40, further including:

a collet being releasably connected to the piston and to the lower housing, the collet being released from the piston when the tool is shifted from its locked position to its released position, the collet having a body portion having a plurality of fingers depending therefrom, the fingers having distal ends, the distal ends having a threaded portion engaged with a threaded portion in the longitudinal bore of the lower housing; and, a locking shoulder on the outer surface of the propellant retainer ring adjacent a first edge thereof, the locking shoulder loading the distal ends of the collet fingers when a well tool is being used to engage a fishing profile on the tool to retrieve the tool and an attached bottom hole assembly.

43. The emergency release tool of claim 42, wherein the longitudinal bore of the loading nut further includes a fishing profile for engaging a well tool to be used in retrieving the emergency release tool and a bottom hole assembly attached thereto upon the coiled tubing being released from the emergency release tool, the forces imparted to the fishing profile by the well tool being transferred to the bottom hole assembly through the shoulder on the slip housing that is bearing against the shoulder on the slip case, through the locking shoulder on the propellant retainer ring that is bearing against the distal ends of the collet fingers, and through the threaded portions on the collet fingers that are threadably engaged with the threaded portion on the lower housing, the threaded portions on the collet fingers and the lower housing being designed to fail at a preselected load, whereby, upon the preselected load being exceeded, the collet being disengaged from the lower housing, and the tool, except for the lower housing, being disengaged from the bottom hole assembly.

44. The emergency release tool of claim 40, wherein the main body portion of the charge mandrel includes an electrical conductor conduit for receiving an individual conductor of a conductor cable.

45. The emergency release tool of claim 44, wherein the main body portion further includes a connector disposed in the electrical conductor conduit for connecting an individual conductor of a conductor cable to a conductor connected to the propellant.

46. The emergency release tool of claim 40, further including an extension connected to a lower end of the charge mandrel for sealably receiving an upper portion of an uppermost tool in a bottom hole assembly.

47. The emergency release tool of claim 32, wherein the piston includes a first extension, a second extension, and a first shoulder adjacent the first extension, the first extension being disposed for longitudinal movement within the longitudinal bore of the slip housing and having an area of increased diameter and an area of reduced diameter, the second extension being disposed for longitudinal movement within the longitudinal bore of the lower housing, the at least one dog in the second end of the slip housing being held within the annular recess in the lower housing by the area of increased diameter on the first extension of the piston when the tool is in its locked position, and the piston being movable to release the at least one dog from the annular recess when the tool is being shifted from its locked position to its released position.

48. The emergency release tool of claim 32, wherein the flared portions on the loading nut and on the slip are flared at angles of approximately three degrees.

49. The emergency release tool of claim 32, wherein the second end of the slip housing includes at least one notch for engaging at least one prong on the first end of the lower housing.

50. The emergency release tool of claim 32, wherein the at least one slip includes a T-shaped end for mating with a corresponding T-shaped slot in the first end of the slip case.

51. The emergency release tool of claim 32, wherein the at least one locking dog housed in the slip case is spring-loaded.

52. The emergency release tool of claim 32, wherein the piston includes a shoulder disposed beneath an aperture in the slip housing, whereby well bore pressure is applied through the aperture to the piston shoulder to maintain a downward force on the piston to counteract any upward forces on the piston that may develop during the drilling process, other than forces generated as a result of the activation of the remotely activated means.

53. The emergency release tool of claim 32, wherein, when the tool is shifted from a locked position to a released position, the shoulder on the slip case engages the shoulder on the slip housing and the locking dogs move outwardly to engage the annular recess in the slip housing.

54. The emergency release tool of claim 32, wherein the remotely activated means is connected to and activated by a conductor cable running through the coiled tubing from the earth's surface to the tool.

55. The emergency release tool of claim 54, wherein the conductor cable may be remotely detached from the emergency release tool and removed from the coiled tubing so that conventional well tools may be used to remove the emergency release tool and a bottom hole assembly attached thereto from the well.

56. The emergency release tool of claim 54, further including means for sealing individual conductors within the conductor cable from drilling fluid being circulated through the tool.

57. The emergency release tool of claim 56, wherein the conductor sealing means includes:

an anchor, an armor nut, a conductor cable sealing connector, and a flow tube;

the anchor being received within the coiled tubing and removably connected to the armor nut;

the anchor and the armor nut having cooperating inclined surfaces for holding an armor portion of the conductor cable;

the conductor cable sealing connector having a plurality of longitudinal bores extending therethrough and including a carrier plug, a composite seal, and a follower plug, the composite seal being disposed between the carrier plug and the follower plug, and each of the individual conductors passing through one of the plurality of longitudinal bores; and, a first end of the flow tube being connected to the armor nut to compress the sealing connector between a shoulder on the flow tube and a shoulder on the armor nut and to compress the composite seal and seal the individual conductors from the drilling fluid, and a second end of the flow tube being received within a longitudinal bore of the inner mandrel.

58. The emergency release tool of claim 57, wherein the conductor cable may be remotely detached from the tool by shearing the armor from between the anchor and the armor nut and removed from the coiled tubing so that conventional well tools may be used to remove the emergency release tool and a bottom hole assembly attached thereto from the well.

59. The emergency release tool of claim 32, wherein the tool releases the coiled tubing in a nondestructive manner so as to leave no enlarged diameters areas on the tubing that could interfere with removal of the coiled tubing from a well.

60. The emergency release tool of claim 32, wherein, upon activation of the remotely activated means to disengage the coiled tubing from the tool, no part of a conductor sealing means within the tool is larger than an outer diameter of the coiled tubing, so that removal of the conductor sealing means from the tool will not interfere with removal of the coiled tubing from a well.

61. The emergency release tool of claim 32, wherein the coiled tubing is released from the tool solely by remote activation of the remotely activated means without mechanical manipulation of the emergency release tool by a well tool.

62. The emergency release tool of claim 32, wherein the coiled tubing is released from the tool solely by remote activation of the remotely activated means without movement of the coiled tubing.

63. The emergency release tool of claim 32, wherein the coiled tubing is released from the tool solely by remote activation of the remotely activated means without movement of a bottom hole assembly connected to the emergency release tool.

64. The emergency release tool of claim 32, wherein the coiled tubing need only be deburred to be installed adjacent the releasable slip.

65. The emergency release tool of claims 32, wherein the annular recess in the lower housing may function as a redundant fishing profile for engaging a well tool to be used in retrieving the emergency release tool and a bottom hole assembly attached thereto upon the coiled tubing being released from the emergency release tool and upon detachment of the lower housing from the remainder of the emergency release tool.

66. The emergency release tool of claim 32, wherein the lower housing further includes an annular load bearing shoulder that may function as a redundant fishing profile for engaging a well tool to be used in retrieving the emergency release tool and a bottom hole assembly attached thereto upon the coiled tubing being released from the emergency release tool and upon detachment of the lower housing from the remainder of the emergency release tool.

67. The emergency release tool of claim 32, wherein a quick disconnect coupler is attached to a second end of the lower housing, the quick disconnect coupler including a pin connector having a series of lugs, a box connector for receiving the pin connector and having a series of recesses to engage and hold the lugs, a rigid spacer between the box and pin connectors for transmitting operating loads through the connection, and an integral sealing means for maintaining a fluidic pressure seal between the pin and box connectors.

* * * * *